US008469201B2

(12) United States Patent
Sasaki et al.

(10) Patent No.: US 8,469,201 B2
(45) Date of Patent: Jun. 25, 2013

(54) IMAGE FORMING SYSTEM

(75) Inventors: Takeshi Sasaki, Kanagawa (JP); Kiichiroh Gotoh, Kanagawa (JP); Junichi Iida, Kanagawa (JP); Masahiro Tamura, Kanagawa (JP); Satoshi Saito, Kanagawa (JP); Ikuhisa Okamoto, Kanagawa (JP); Junichi Tokita, Kanagawa (JP); Shingo Matsushita, Tokyo (JP); Takahiro Watanabe, Kanagawa (JP); Akira Kunieda, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 204 days.

(21) Appl. No.: 13/064,135

(22) Filed: Mar. 8, 2011

(65) Prior Publication Data

US 2011/0220557 A1 Sep. 15, 2011

(30) Foreign Application Priority Data

Mar. 15, 2010 (JP) ..... 2010-058519

(51) Int. Cl.
*B07C 5/16* (2006.01)

(52) U.S. Cl.
USPC ..... 209/592; 209/645; 209/900; 271/2

(58) Field of Classification Search
USPC ..... 209/592, 645, 900; 271/2; 177/52
See application file for complete search history.

(56) References Cited

U.S. PATENT DOCUMENTS 4,800,505 A * 1/1989 Axelrod et al. ..... 700/221
5,119,306 A * 6/1992 Metelits et al. ..... 705/406
5,229,932 A * 7/1993 Connell et al. ..... 705/1.1
5,329,102 A * 7/1994 Sansone ..... 235/375
6,510,992 B2 * 1/2003 Wells et al. ..... 235/385
6,651,878 B2 * 11/2003 Malatesta et al. ..... 235/375
6,861,592 B2 * 3/2005 Gerstenberg et al. ..... 177/1
7,610,248 B1 * 10/2009 Nowlin et al. ..... 705/401
8,028,982 B2 * 10/2011 Gorp et al. ..... 270/58.06
2009/0232622 A1 9/2009 Okada et al.
2009/0257846 A1 10/2009 Matsushita et al.
2009/0263212 A1 10/2009 Sasaki et al.
2009/0269167 A1 10/2009 Iida et al.
2010/0072692 A1 3/2010 Iida et al.
2010/0226733 A1 9/2010 Ilda et al.
2010/0239391 A1 9/2010 Sasaki et al.

FOREIGN PATENT DOCUMENTS

JP 3110804 B 9/2000
JP 3110806 B 9/2000

OTHER PUBLICATIONS

Abstract of Japanese Patent Publication No. JP05-035030, published Feb. 12, 1993.
Abstract of Japanese Patent Publication No. JP05-027523, published on Feb. 5, 1993.

* cited by examiner

*Primary Examiner* — Joseph C Rodriguez
(74) *Attorney, Agent, or Firm* — Harness, Dickey & Pierce, P.L.C.

(57) ABSTRACT

An image forming system includes an SSP unit (sorting guide portion and envelope chuck portion) that functions as an enclosing unit or an enclosing device to enclose, in envelopes, paper on which an image is formed by a copy machine functioning as an image forming device, a weight measuring device that includes a load cell to measure the weight of the paper-enclosed envelopes, and a sorting device that sorts the paper-enclosed envelopes, on the basis of weight data of each of the paper-enclosed envelopes of which the weight is measured by the weight measuring device.

6 Claims, 25 Drawing Sheets

IMAGE FORMING SYSTEM

CROSS-REFERENCE TO RELATED APPLICATIONS

The present application claims priority to and incorporates by reference the entire contents of Japanese Patent Application No. 2010-058519 filed in Japan on Mar. 15, 2010.

BACKGROUND OF THE INVENTION

1. Field of the Invention

The present invention relates to an image forming system that includes an image forming device and a post-processing device having an enclosing device, and more particularly, to an image forming system that is connected with an image forming device that may form an image on sheets including envelopes and a post-processing device including an enclosing device that encloses, in the envelopes, contents such as the sheets on which the image is formed by the image forming device.

2. Description of the Related Art

In the related art, there is already known a paper processing device that is configured to automatically perform the work for enclosing, in an envelope, paper (sheet) loaded on a paper loading unit such as a bin (for example, Japanese Patent Nos. 3110806 and 3110804).

Japanese Patent No. 3110806 discloses the paper processing device that performs image forming and printing on the content and the envelope through an in-line process, and then encloses the content in the envelope. Further, in order to avoid the failure of enclosing process, there is also disclosed the configuration of a system that determines whether the paper can be enclosed in the envelope on the basis of information on paper size and envelope size.

However, in the in-line enclosing device (image forming system) disclosed so far, which includes an image forming device and a post-processing device, as well as in the technologies disclosed in Japanese Patent Nos. 3110806 and 3110804, an inspection mechanism is not generally included which inspects whether there is an excess or deficiency in enclosing of the contents. Therefore, when the inspection is necessary, an inspection device needs to be connected to the rear side of the system, in which the inspection device measures and determines the weight or thickness of the enclosed/sealed envelope.

In this case, a failure determination is performed after the envelope has been sealed, so it is difficult to confirm determination of a failure or correct the envelope determined as the failure in manual. In the case of using the configuration where the envelope is sealed after the inspection, the sealing device needs to be connected to the rear side of the inspection device, and thus the size of system increases and various setting operations are troublesome. For this reason, it is very difficult to use the system.

SUMMARY OF THE INVENTION

It is an object of the present invention to at least partially solve the problems in the conventional technology.

In order to solve above-mentioned problems and achieve the object, there is provided an image forming system according to an aspect of the present invention, the image forming system includes an image forming unit that forms an image on sheets including envelopes, an enclosing unit that encloses, in the envelopes, the sheets on which the image is formed by the image forming unit, a weight measuring unit that measures the weight of the sheet-enclosed envelopes, and a sorting unit that sorts the sheet-enclosed envelopes, on the basis of weight data of each of the sheet-enclosed envelopes of which the weight is measured by the weight measuring unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
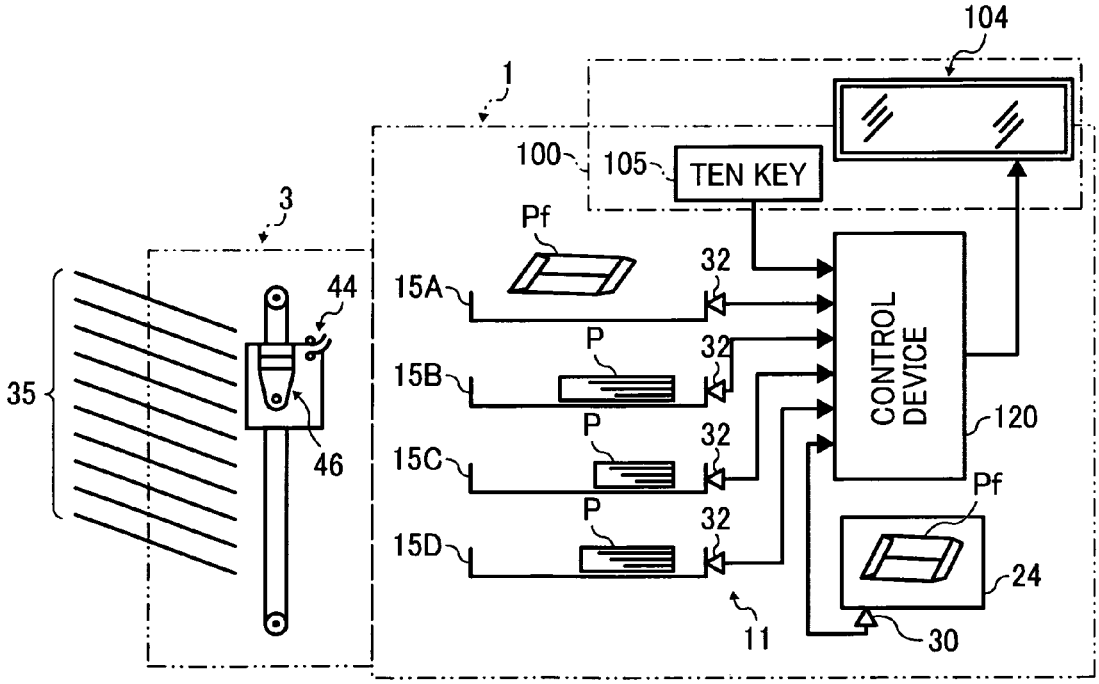
FIG. 1 is a diagram showing the schematic configuration of an image forming system according to an embodiment of the present invention, a size detecting system to detect a size of paper or an envelope, and a control system.

Hereinafter, an embodiment of the present invention will be described in detail with reference to the accompanying drawings. In the embodiment, components (members or parts) having the same function and shape are denoted by the same reference numerals, as long as there is no fear of the confusion, and the description thereof is not repeated. In order to simplify the drawings and the description, the components that do not need to be specially described in a drawing among the components to be shown in the drawing may be omitted in the drawing.

Referring to FIG. 1, an image forming system according to an embodiment of the present invention will be described. FIG. 1 shows the schematic configuration of the image forming system according to the embodiment of the present invention, a size detecting system to detect a size of paper or an envelope, and a control system to input a detection signal of the size detecting system. Hereinafter, in this embodiment, an "envelope" corresponding to a mail is described as a mail object. The hardware configuration of this embodiment uses a part of the components and the operation of the paper processing device of Japanese Patent Nos. 3110806 and 3110804 disclosed in the related art.

The image forming system shown in FIG. 1 is composed of a system that includes a digital copy machine (hereinafter, simply referred to as "copy machine") 1 corresponding to an example of an image forming device and a sorter/stapler/packager device (hereinafter, simply referred to as "SSP device") 3 functioning as a post-processing device mounted to the sheet discharging side of a device body 1A in the copy machine 1.

The copy machine 1 functions as an image forming unit (in a broad sense) that can form an image on paper corresponding to a sheet including an envelope and carry the image formed envelope or paper.

The SSP device 3 includes paper loading bins (hereinafter, simply referred to as "bins") 35 that function as plural paper loading units (sheet loading units) to load the image formed envelope or paper P carried from the device body 1A, a sort guide section 44 becoming a sorting/discharging unit that sorts the image formed paper P fed from a feed portion 11 functioning as a paper (sheet) storage portion of the device body 1A to the individual bins 35 and discharges the paper, and a pack unit 46 becoming a unit that carries the paper P on the bins 35 into an envelope Pf.

In the feed portion 11, feed cassettes 15A to 15D and a tray 24 are disposed. The feed cassettes 15A to 15D and the tray 24 are configured such that the fed paper P and the envelope Pf can be stored and set.

In addition to the paper, the sheets include all sheet-like recording media such as a mail (envelope or postcard), thick paper, and an OHP film where an image can be formed by the image forming unit. Therefore, the image forming unit is not limited to the electrophotographic copy machine 1 according to this embodiment. For example, the image forming unit may be an image forming device, such as a single-color and full-color copy machine of an electrophotographic/magnetic recording system, an inkjet recording device, printers including a stencil printer, and an MFP having two or more functions.

The copy machine 1 has size detecting sensors 32 and a size detecting device 30 that perform both functions of a paper (sheet) size detecting unit and an envelope size detecting unit to detect sizes of the paper P and the envelope Pf fed from the feed cassettes 15A to 15D and the tray 24 of the feed portion 11, a display unit 104 (envelope size display unit) that functions as a size notifying unit and a size display unit to display the size of the envelope detected by a size detecting system, and a control device 120 that has the same function as that disclosed in Japanese Patent Nos. 3110804 and 3110806 for recognizing and determining the size of the envelope capable of storing the paper P having the size detected by each size detecting sensor 32 and the size detecting device 30 and collating the determined size of the envelope and the size of the envelope detected by the size detecting sensors 32 and the size detecting device 30 and various functions disclosed in this embodiment.

The copy machine 1 that is described in detail below includes an operation panel 100 (refer to FIGS. 32A and 32B) that functions as an operation unit including a ten key 105 functioning as a sheet number setting unit to set/input (hereinafter, simply referred to as "set") the number of paper enclosed in the envelope and the display unit 104. When an "envelope enclosing mode" where the paper is enclosed in the envelope is selected, the control device 120 functions as a used envelope selecting unit that selects the used envelope from the envelopes having the recognized size capable of storing the paper having the size detected by the size detecting sensor 32 and the size detecting device 30 by the set number of paper. When the set number of paper exceeds the recognized/determined number of paper, the control device 120 releases the "envelope enclosing mode." When the "envelope enclosing mode" is selected, the control device 120 controls the display unit 104 to perform display to set the number of paper enclosed in the envelope.

In this case, each size detecting sensor 32 and the size detecting device 30 function as a size detecting unit to detect the size of the envelope or the paper and a size measuring unit to measure the size of the envelope or the paper. The size recognizing unit that recognizes the size of the envelope or the paper includes a size setting unit that manually sets the size of the envelope, in addition to the size detecting unit and the size measuring unit. Specifically, the size setting unit manually sets the size of the envelope using the ten key 105, an enter key 107, and the display unit 104 that are disposed in the operation panel 100 shown in FIGS. 32A and 32B to be described below. As such, in this embodiment, the plural size detecting units are provided.

The control device 120 that is described in detail below has a function as a sorting control unit that controls a sorting unit (to be described below) to sort the paper-enclosed envelopes, on the basis of weight data of each of the paper-enclosed envelopes output from the weight measuring unit (refer to FIGS. 24A to 24C to be described below) to measure the weight of the envelope where the paper (sheet) on which the image is formed by the copy machine 1 according to this embodiment is enclosed.

Figure 2:
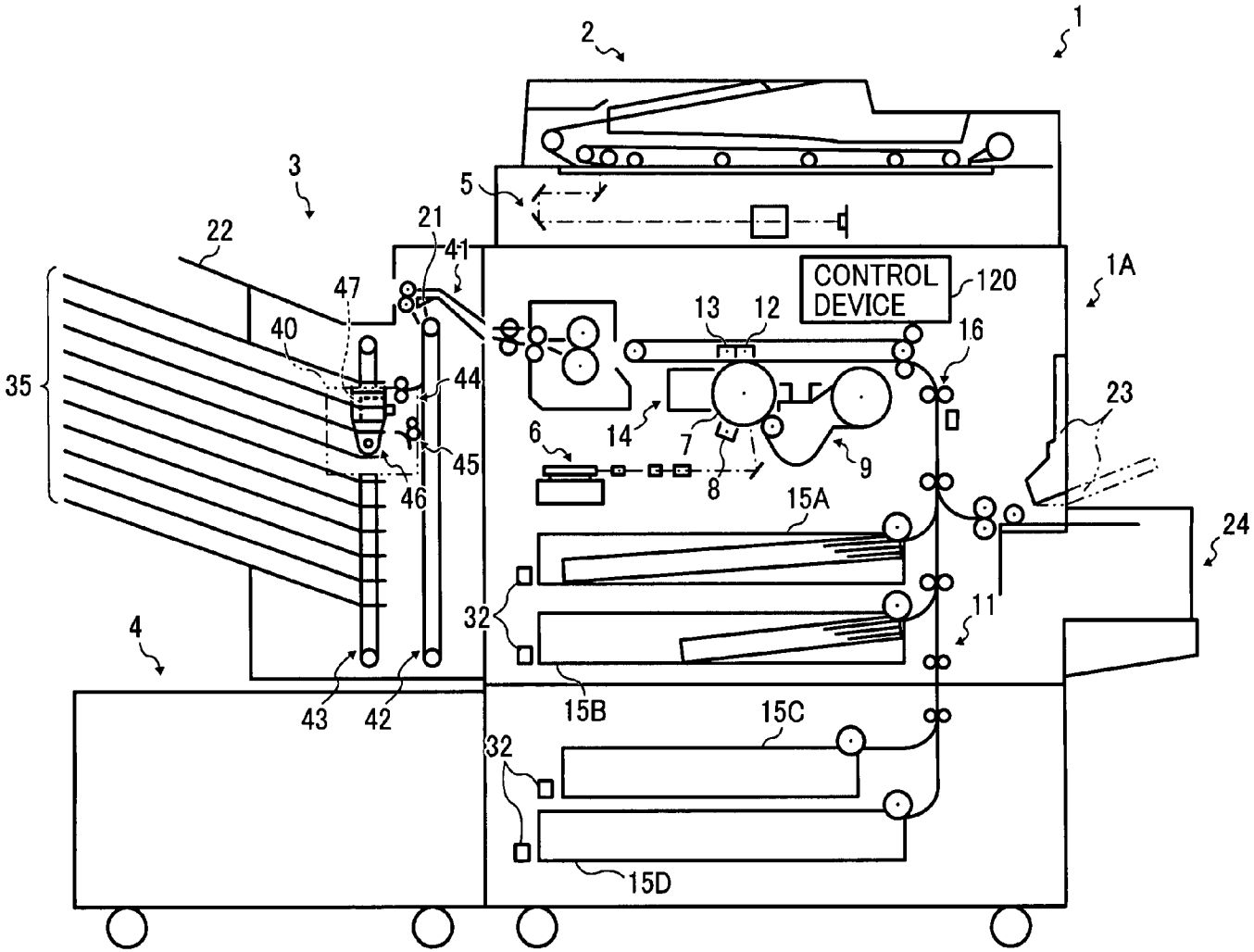
FIG. 2 is a diagram showing the entire configuration of a digital copy machine and an SSP device that constitute the image forming system shown in FIG. 1.
Figure 6:
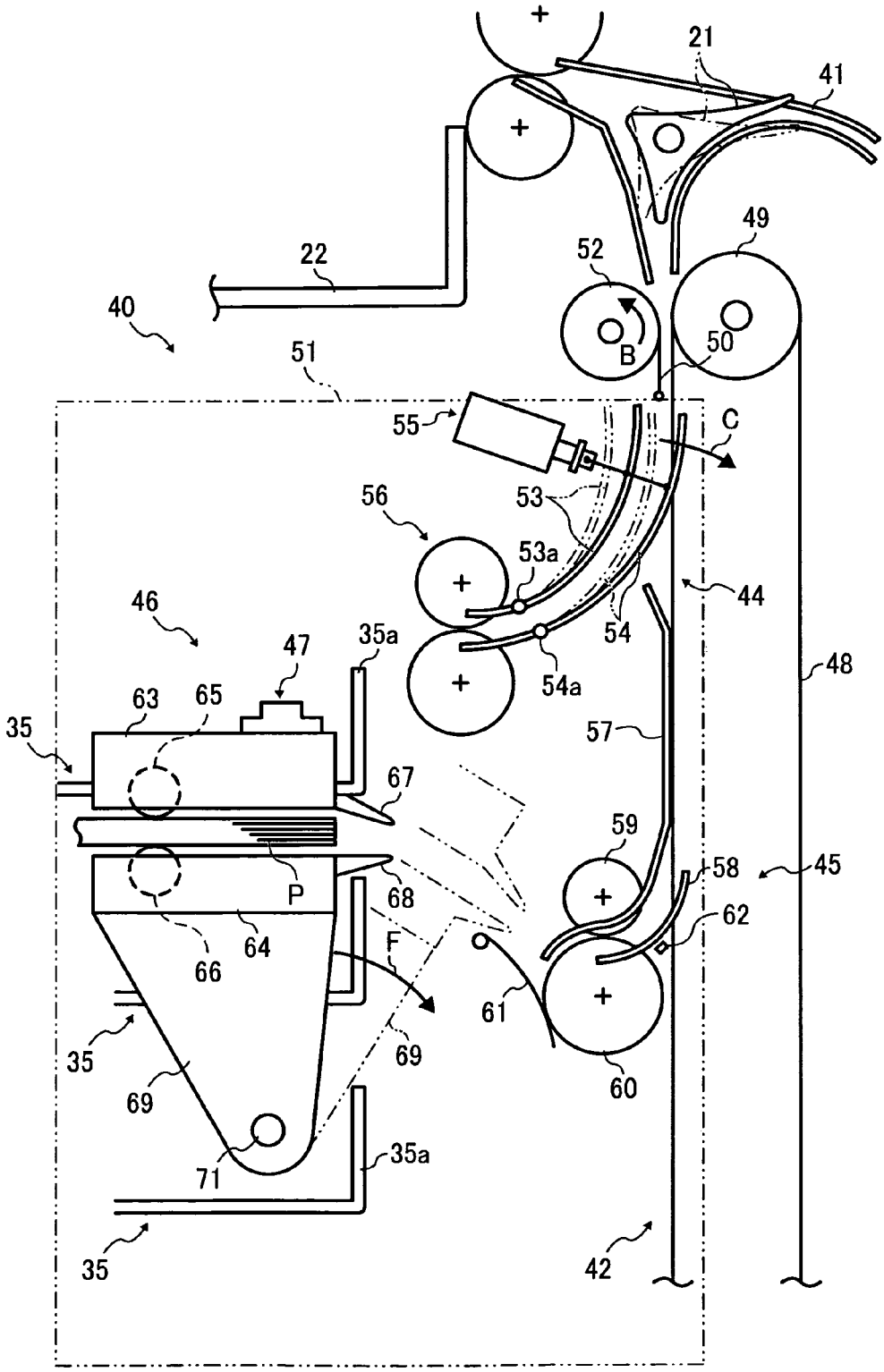
FIG. 6 is an enlarged front view showing an SSP unit of the digital copy machine of FIG. 1.

In this embodiment, there will be described the envelope where at least one paper (sheet) on which an image is formed is enclosed as a content of the envelope to be mailed. An enclosing unit, an enclosing mechanism, or an enclosing device that enclose at least one paper in the envelope mainly include an envelope chuck section 45 of the SSP device 3 shown in FIGS. 2 and 6 (to be described below) and a pack unit 46 that is shown in FIGS. 1, 2, and 6 (narrowly defined configuration). The broadly defined enclosing unit, enclosing mechanism, or enclosing device include an SSP unit 40.

Referring to FIG. 2, the entire configuration of the image forming system that encloses the paper in the envelope and the configuration and the operation of a main portion of the copy machine 1 will be described. As shown in FIG. 2, in the copy machine 1, a recirculating document handler (RDH) 2 is mounted on an upper portion of the device body 1A, the SSP device 3 that corresponds to the post-processing device is mounted on an upper portion of a left side, and a storage carrier 4 that stores the paper-enclosed envelope is mounted on a lower portion of the SSP device 3. The storage carrier 4 has the specific configuration in the present invention, that is, a loading unit that loads the paper-enclosed envelopes sorted by the sorting unit to be described in detail below.

In the copy machine 1 shown in FIG. 2, image information after subjected to image processing by an image scanning section 5 is written in a photosensitive drum 7 functioning as an image carrier in a form of a set of light spots, by raster scanning of a laser beam with a writing section 6. A semiconductor laser is used as a laser light source for the laser beam.

A surface of the photosensitive drum 7 is uniformly negatively charged by an electric charger 8 of a corotron system. When the laser beam illuminates the negatively charged photosensitive drum 7 and the potential of an image portion thus illuminated decreases, an electrostatic latent image where the potential of a background portion is −750 to −800 V and the potential of an image portion is about −50 V is formed on the surface of the photosensitive drum 7.

The electrostatic latent image is developed by a toner negatively charged by applying a bias voltage of −500 to −600 V by a developing roller of a developer 9. The developed image is transferred to the surface of the paper (transfer paper) P that is fed from the feed section 11 and is timed with the rotation of the photosensitive drum 7, by applying charges of the positive potential from the back side of the paper by a transfer charger 12.

The paper on which the image is transferred is neutralized by alternating current with a separation charger 13 held integrally with the transfer charger 12 and thus the paper is separated from the surface of the photosensitive drum 7. At this time, the toner that remains on the photosensitive drum 7 is scraped from the surface of the photosensitive drum 7 by a cleaning blade (not shown in the drawings) of a cleaning device 14 and is stored in a collection tank (not shown in the drawings). The potential that remains on the surface of the photosensitive drum 7 is removed by illumination of light using a neutralization lamp (not shown in the drawings).

Meanwhile, the paper P on which the image is transferred is selectively fed from one of four steps of the feed cassettes 15A to 15D provided in the feed section 11, according to the size of the paper. That is, if the feed cassette at one of the feed steps is selected by an operator and a start key 108 (refer to FIG. 32) is pressed, a feed roller that functions as a sheet feed unit of the selected feed step rotates and the paper in the feed cassette is fed. The fed paper is fed until the paper bumps into a nip of a resist roller 16 by rollers functioning as sheet conveying unit provided at plural places (not shown in the drawings) on a sheet conveyance path.

The resist roller 16 feeds the paper to the photosensitive drum 7 at such timing that the position of the image formed on the photosensitive drum 7 and the position of the paper are matched with each other.

In this way, the paper P is fed, the image is transferred to the paper by the abovementioned method, and the image (toner image) is fixed by a fixing roller. The paper P on which the image is fixed is fed to the SSP device 3. In normal printing, the paper P is guided by a switching claw that is switched to a position of a straight advancement state and thus is discharged to a discharge tray 22.

Figure 3:
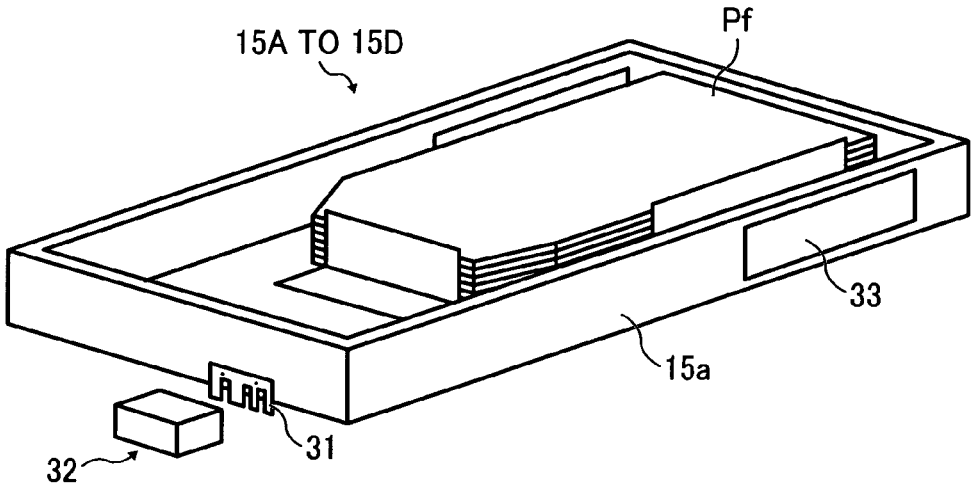
FIG. 3 is a perspective view showing a feed cassette that is mounted to a feed portion of the digital copy machine of FIG. 1.
Figure 4:
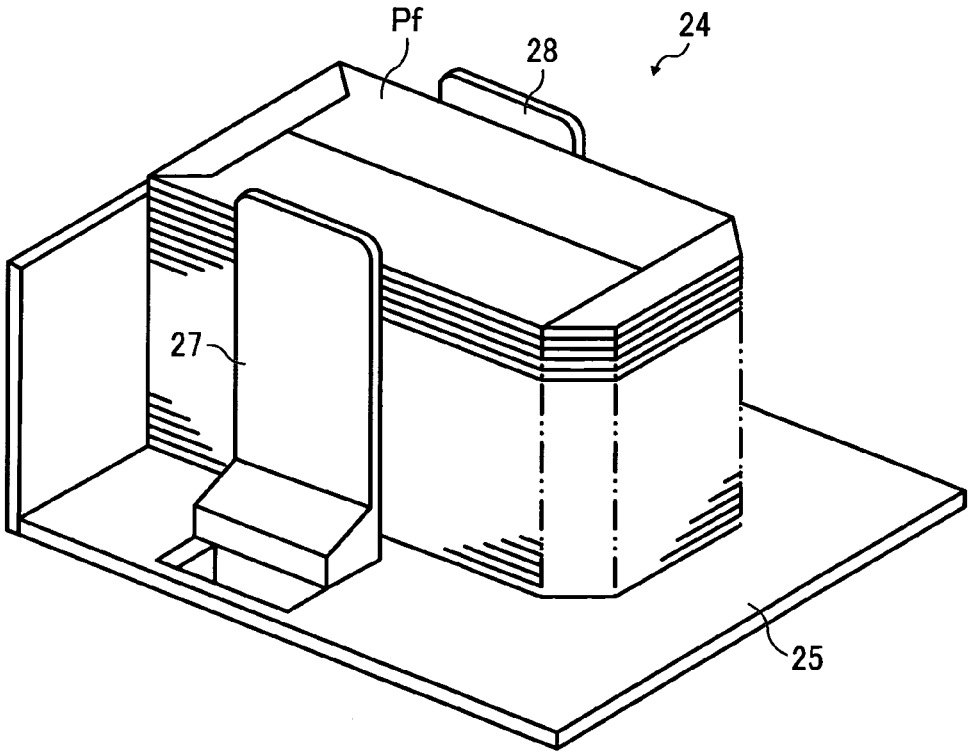
FIG. 4 is a perspective view showing a state where an envelope is set to a tray of the digital copy machine of FIG. 1.
Figure 5:
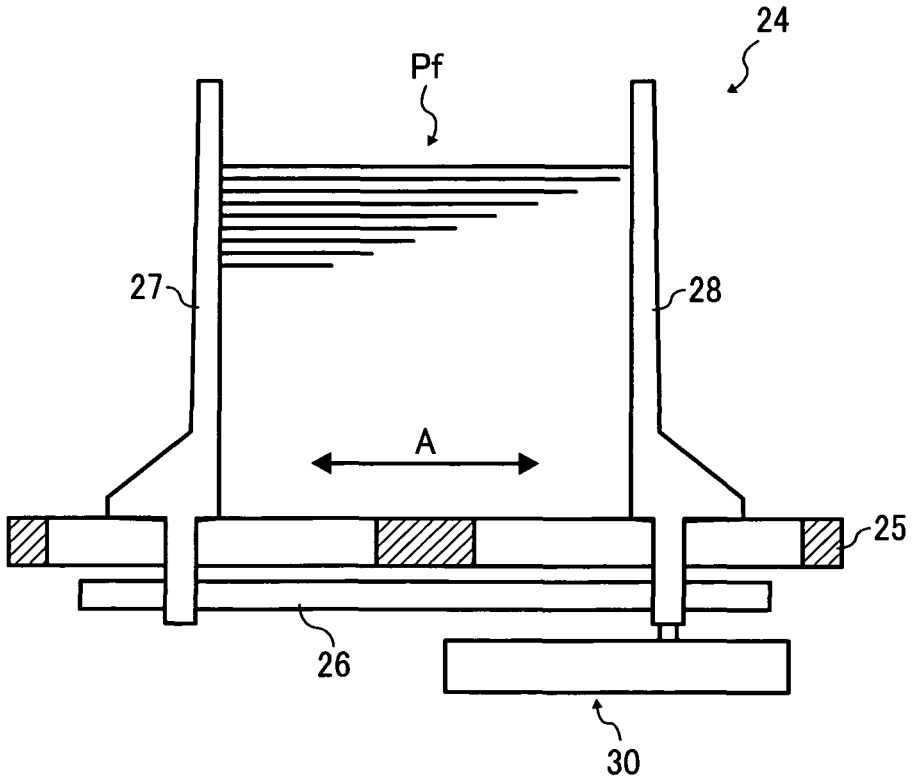
FIG. 5 is a side view of a size detecting device that detects a size of the envelope set to the tray of FIG. 4.

Referring to FIGS. 3 to 5, a feeding device that feeds the envelope will be described. FIG. 3 is a perspective view showing the feed cassettes 15A to 15D of, the feed portion 11 shown in FIGS. 1 and 2 and a size detecting system (size detecting unit) functioning as the paper size detecting unit and the envelope size detecting unit.

To each of the feed cassettes 15A to 15D of the feed portion 11, a size instruction plate 31 that is formed to correspond to the size of each paper or the size of each envelope to be stored is attached. If the feed cassettes are set to the device body, the size detecting sensor 32 that is provided to correspond to the size instruction plate 31 at the side of the device body detects the size instruction plate 31 and detects the sizes of the paper and the envelope entered in the feed cassettes (in FIG. 3, the envelope Pf is set and stored).

A size seal 33 where the size of the paper or the envelope corresponding to a material stored in the feed cassettes 15A to 15D is displayed is bonded to a side 15*a* of each of the feed cassettes 15A to 15D, such that a user can know the size of the material stored in the feed cassettes at one view.

The feed of the paper in the copy machine 1 can also be made from a manual tray 23 that is disposed on the right side of the device body 1A in FIG. 2 and can be opened and closed at the position shown by a solid line and a virtual line as well as from a tray 24 that is provided below the manual tray 23.

As shown in FIGS. 4 and 5, the tray 24 is configured to be able to store larger number of the paper or the envelopes than that can be stored in the feed cassettes 15A to 15D. In the tray 24, the paper or the envelope Pf is loaded on a bottom plate 25, and is nipped by a pair of side guides 27 and 28 slidable in a direction of an arrow A along a guide rod 26 shown in FIG. 5 to be set at the central position of the bottom plate 25.

Below the bottom plate 25, the size detecting device 30 (for example, composed of a known variable resistance type position sensor) that detects the position of the side guide 28 to detect the size of the paper or the envelope loaded on the bottom plate 25 is disposed. The size of the paper or the envelope Pf shown in the drawing set on the bottom plate 25 can be detected and recognized by comparing a value detected by the size detecting device 30 with size data previously stored in a ROM 132 of a main control board 130 described later constituting the control device 120.

Referring to FIG. 6, the enclosing unit, the enclosing mechanism or the enclosing device that encloses at least one paper in the envelope will be described.

The SSP device 3 that functions as the post-processing device and is shown in FIG. 2 discharges the paper or the envelope, on which the image is formed and which is discharged from the device body 1A shown in FIG. 2, to the discharge tray 22 as described above, sorts the paper according to the selected mode contents and discharges the paper to the individual bins 35 disposed in the multiple steps, binds the paper by a stapler 47, and feeds the paper to the envelop.

The SSP device 3 includes plural paper loading bins 35 to load the paper, a horizontal conveying path 41 to discharge the paper discharged from the device body 1A to the discharge tray 22, a vertical conveyance path 42 to carry the paper or the envelope guided to the lower side by a switching claw 21 provided on the horizontal conveying path 41 to the lower side, and the SSP unit 40 to selectively discharge the paper fed to the vertical conveyance path 42 to the bins 35.

The SSP unit 40 is elevated between the bins, by an elevating device 43 (refer to FIG. 20) including a motor, upper and lower pulleys, and an endless driving belt stretched between the motor and the upper and lower pulleys. The SSP unit 40 includes the sort guide section 44 that becomes a sorting/discharging unit to sort the paper p where the image is formed in the device body 1A shown in FIG. 2 to each bin 35 and discharge the paper as shown in FIG. 6, a pack unit 46 that is a unit to be provided below the sorting guide unit and carry the paper (not shown in the drawings) on the bin 35 into the envelope held by the envelope chuck section 45, and the stapler 47 that is mounted integrally with the pack unit 46.

In this case, the SSP unit 40 functions as an enclosing unit, an enclosing mechanism or an enclosing device that encloses the contents such as the paper to be mailed in the envelope (broadly defined enclosing unit). As described above, the narrowly defined enclosing unit or enclosing mechanism mainly includes the envelope chuck section 45 that is shown in FIGS. 2 and 6 and the pack unit 46 that is shown in FIGS. 2 and 6.

The vertical conveyance path 42 is configured using an endless conveyance belt 48 that is rotatably stretched between the upper and lower pulleys 49 (the lower side is not viewed in FIG. 6) to be vertically provided, and a extension belt 50 is provided to contact the conveyance belt 48. In the extension belt 50, one end is fixed to an upper end of a frame 51 of the SSP unit 40 and the other end is fixed to a winding roller 52 rotatably mounted to a fixing portion of the device body in the SSP device 3. The extension belt 50 is wound by rotation of the roller 52 in a direction of an arrow B.

The winding roller 52 is always biased by a spring (not shown in the drawings) in the direction of the arrow B in which the extension belt 50 is wound, the extension belt 50 is delivered or wound according to the vertical movement of the SSP unit 40, the predetermined tension is always applied to the extension belt 50 so that the extension belt 50 is not loosened, and the vertical conveyance path 42 is formed between the conveyance belt 48 and the extension belt 50.

Figure 7:
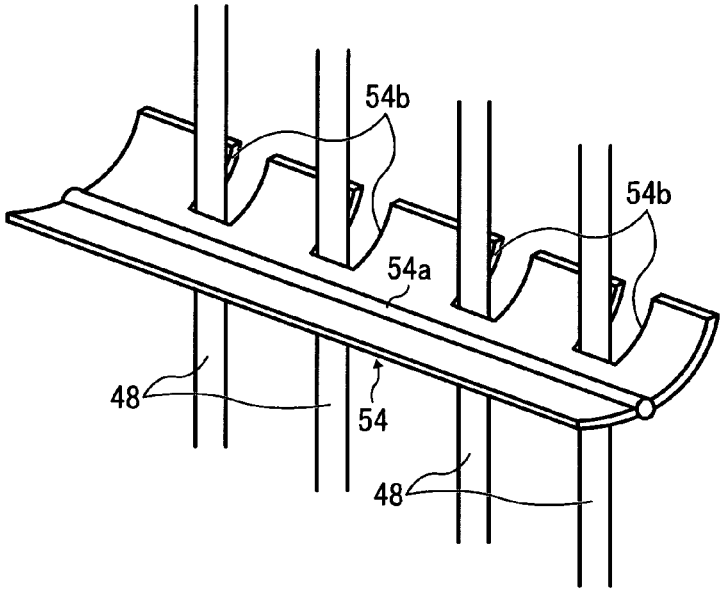
FIG. 7 is a perspective view showing a positional relationship of a sorting guide and a carriage belt of the SSP unit.
Figure 8:
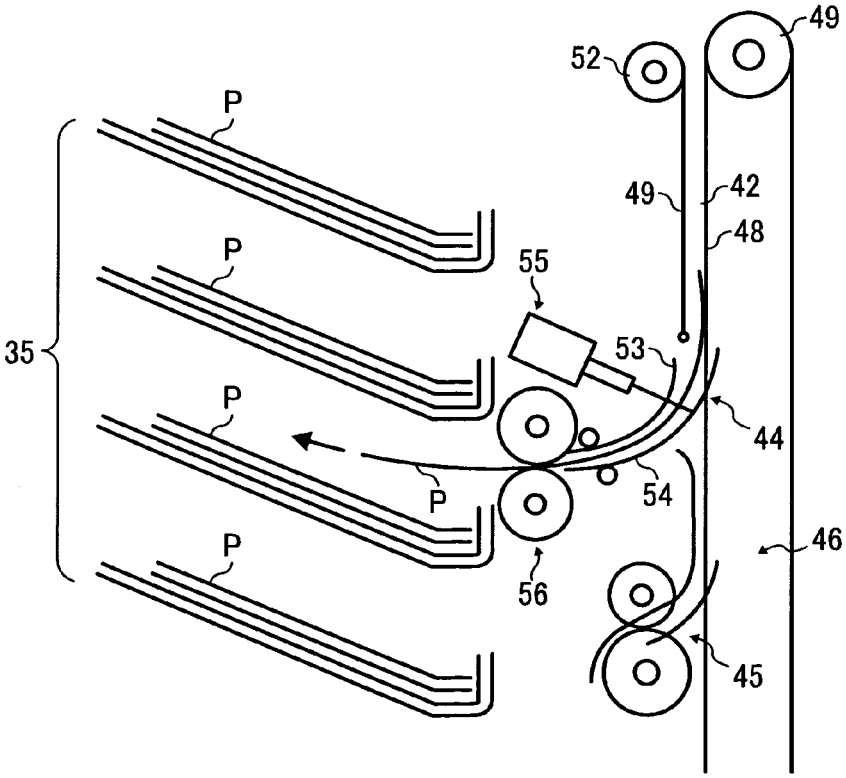
FIG. 8 is a front view showing an aspect where paper is discharged to a bin by the sorting guide of the SSP unit.

Referring to FIGS. 6 to 9, the sort guide section 44 will be described. In FIGS. 6 and 8, the sort guide section 44 is a device that sorts the paper P to each bin 35. Swing support portions 53*a* and 54*a* are formed in the vicinity of lower ends of a pair of sort guides 53 and 54 made of thin plate members formed in an arc shape so that movable guide portions that are portions of the sort guide section 44 located above the swing support portions 53*a* and 54*a* are configured to be swingable in a direction of an arrow C. A movable shaft of a solenoid 55 is attached to the movable guide portions so that the movable guide portions are moved to the position shown by a virtual line in FIG. 10 when the solenoid 55 is turned on.

Respective ends of the pair of the sort guides 53 and 54 that are located under the swing support portions 53*a* and 54*a* are fixed to the frame 51 and a discharge roller pair 56 is inserted in a cut groove formed at the ends sort guides 53 and 54 without interference therewith.

As shown in FIG. 7, in the lower sort guide 54, notch grooves 54*b* that respectively receive the plural conveyance belts 48 are disposed at an approximately equivalent interval in an anteroposterior direction without interference therewith. As a result, driving of the conveyance belt 48 is not affected even when the sort guide 54 is positioned at the position shown by a solid line in FIG. 6.

In the sort guide section 44, when the paper P is sorted to each bin 35, the solenoid 55 is in the off state. Therefore, as shown in FIG. 8, the paper P that is conveyed downwardly by the conveyance belt 48 of the vertical conveyance path 42 is fed between the sort guide pair 53 and 54 at the position shown in the drawing, and is discharged to the bin 35 designated by the discharge roller pair 56.

Figure 9:
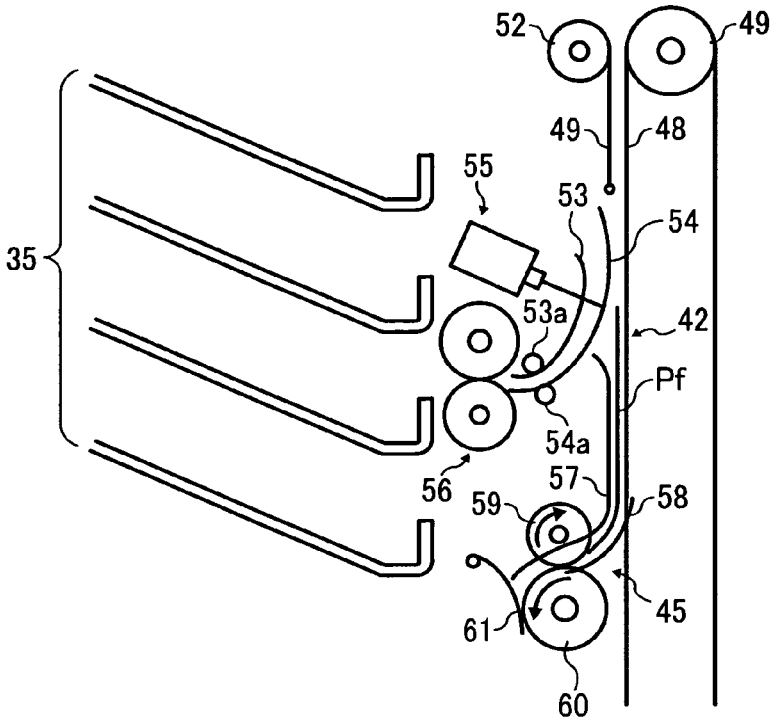
FIG. 9 is a front view showing an aspect where the envelope is carried to an envelope chuck portion in the SSP unit.

Meanwhile, when the paper that is conveyed to the vertical conveyance path 42 is the envelope Pf and the envelope is conveyed to the envelope chuck section 45, the solenoid 55 becomes an on state. Therefore, as shown in FIG. 9, the sort guides 53 and 54 are swinged about the swing support portions 53*a* and 54*a* to the position shown in FIG. 9 to be moved away from the vertical conveyance path 42, and the vertical conveyance path 42 to convey the envelope Pf downwardly is formed by the back surface (bottom surface) of the lower sort guide 54 and the conveyance belt 48. Therefore, the envelope Pf that is conveyed downwardly along the vertical conveyance path 42 is conveyed to the envelope chuck section 45 by the conveyance belt 48.

Figure 10:
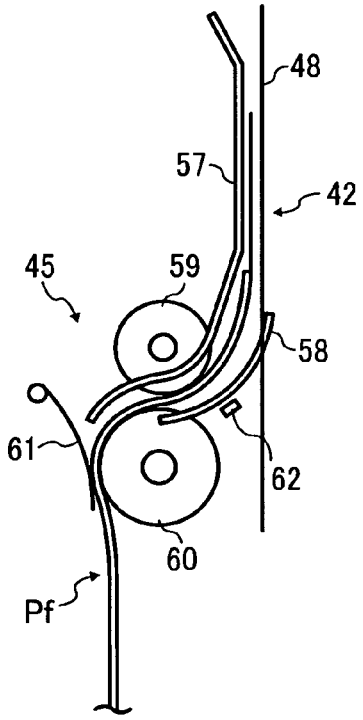
FIG. 10 is a front view showing an aspect where the envelope is carried to the envelope chuck portion, following FIG. 9.

Referring to FIGS. 10 to 13, the envelope chuck section 45 will be described. As shown in FIG. 10, the envelope chuck section 45 mainly includes a pair of chuck rollers 59 and 60 (they may be rollers) that can contact to be forced toward one another in a vertical direction and rotate, a pair of envelope guides 57 and 58 that guide the envelope Pf to a nip portion of the chuck roller pair 59 and 60, an envelope detecting sensor 62 that is disposed on the conveyance at the upstream of the nip portion of the chuck roller pair 59 and 60, and an envelope opening mylar 61 that is a elastically deformable sheet-like envelope opening member that abuts a part of the lower chuck roller 60. These components are attached to the frame 51 (refer to FIG. 6) in a unit state and moves vertically together with the sort guide section 44.

The part of the opening mylar 61 is inserted into an opening of the envelope Pf held by the pair of chuck rollers 59 and 60 and the opening mylar 61 is disposed at the position where the envelope Pf can be opened.

The pair of chuck rollers 59 and 60 is disposed in an approximately vertical direction. When the envelope Pf or the paper is carried, the pair of chuck rollers 59 and 60 contacts in pressure and rotates. The pair of envelope guides 57 and 58 guides the envelope Pf to the position where the paper is fed from the vertical conveyance path 42 and guides the envelope to the nip portion of the pair of chuck rollers 59 and 60. The pair of envelope guides 57 and 58 further guides the envelope Pf arrived at the pair of chuck rollers 59 and 60 to the lower side. At this time, the pair of envelope guides 57 and 58 guides the envelope Pf along the lower chuck roller 60.

In this case, the pair of chuck rollers 59 and 60 according to this embodiment functions as a carriage unit that nips and carries the envelope Pf. As compared with the configurations that are disclosed in Japanese Patent Nos. 3110806 and 3110804, the pair of chuck rollers 59 and 60 that functions as the carriage unit according to this embodiment adopts the specific configuration where the nip pressure can be released by a nip pressure releasing mechanism (not shown in the drawings) that functions as a pressure-contact releasing unit to release the pressure-contact with respect to the envelope Pf. The detailed description is given below.

Figure 12:
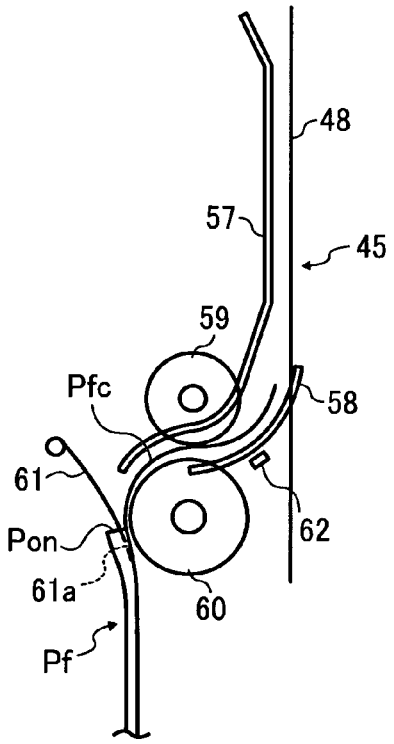
FIG. 12 is a front view showing a state where the lower end of the opening mylar enters into the envelope.

The envelope opening mylar 61 is formed of, e.g., a thin film-like resin material, is disposed to be adjacent to the chuck roller 60, an upper end thereof is fixed, and a portion thereof slightly above the lower end is usually brought into a contact with the lower chuck roller 60 by virtue of the elastic force of the material of the envelope opening mylar 61. However, when the paper is guided into the envelope, as shown in FIG. 12, a portion near a lower end 61*a* is inserted into the opening Pon of the envelope Pf so that the envelope opening mylar 61 guides the paper P (refer to FIG. 6), which is fed by the pack unit 46, to the opening Pon.

As shown in FIG. 9, when the envelope Pf is conveyed to the lower side by the conveyance belt 48, the envelope chuck section 45 guides the envelope Pf between the chuck roller pair 59 and 60 by the envelope guide pair 57 and 58. Next, the envelope Pf is fed between the chuck roller 60 and the envelope opening mylar 61 by the conveyance force of the chuck roller pair 59 and 60 rotating in an arrow direction of FIG. 9, as shown in FIG. 10.

Figure 11:
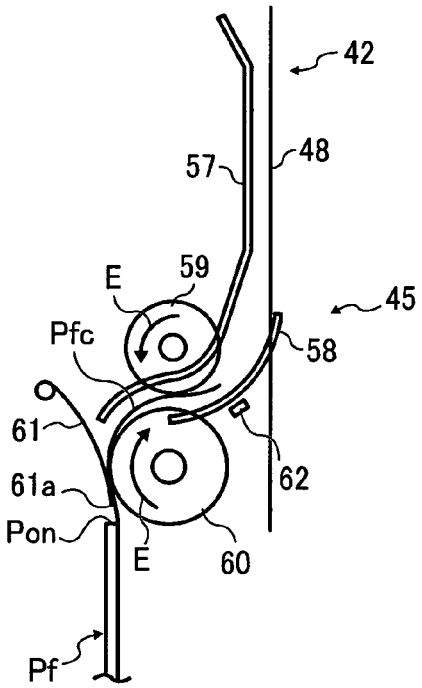
FIG. 11 is a front view showing a state where an opening of the envelope is maintained at the lower side of a lower end of an opening mylar in the envelope chuck portion.

When the portion of the flap Pfc of the envelope Pf is nipped between the pair of chuck rollers 59 and 60 as shown in FIG. 11, if the envelope detecting sensor 62 detects the passage of the end of the flap Pfc, the pair of chuck rollers 59 and 60 stops the rotation and feeding of the envelope Pf is stopped. At this time, the envelope Pf is fed by the predetermined amount, according to the vertical size of the envelope Pf, such that the opening Pon of the envelope Pf is positioned at the lower side of the lower end 61*a* of the opening mylar 61, as shown in FIG. 11.

Figure 13:
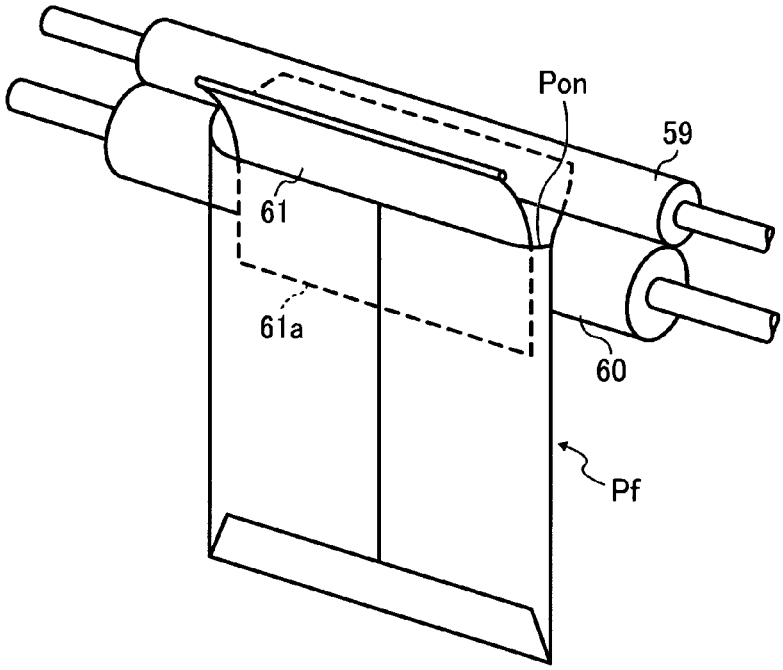
FIG. 13 is a perspective view showing a state where the opening mylar enters into a lower end of the envelope, similar to FIG. 12.

Next, the chuck roller pair 59 and 60 starts to reversely rotate in a direction of an arrow E, and the envelope Pf is switched back to go up the vertical conveyance path 42. At this time, because a portion of the envelope opening mylar 61 near the lower end 61*a* contacts the portion of the flap Pfc of the envelope by the self elastic force of the envelope opening mylar 61, the lower end 61*a* of the envelope opening mylar is inserted into the opening Pon of the envelope Pf, as shown in FIG. 12. In this state, the reverse rotation of the chuck roller pair 59 and 60 is stopped and rising of the envelope Pf is stopped. Therefore, the envelope Pf is set in an envelope opening state where the lower end 61*a* of the envelope opening mylar 61 is inserted into the opening Pon of the envelope Pf, as shown in FIG. 13.

Referring to FIGS. 6 and 14 to 18, the pack unit 46 will be described. As shown in FIG. 6, the pack unit 46 includes an upper pack section 63 and a lower pack section 64, and the upper roller 65 is rotatably attached to the upper pack section and the lower roller 66 is rotatably attached to the lower pack section.

A pair of upper and lower insertion guides 67 and 68 are swingably attached to the right ends, in the drawings, of the upper and lower pack sections 63 and 64, are biased by a weak spring such that the front ends thereof approach each other, and are pushed and opened when a bundle of paper P pass between the upper and lower insertion guides 67 and 68. As a result, the paper P is conveyed without receiving large resistance.

A pair of pack units 46 is provided in anteroposterior direction such that the bin 35 is located between the pack units, as shown by a virtual line in FIG. 14, and can be moved in a vertical direction in notched portions 35*b* and 35*c*, which are formed by cutting off both sides of a bin fence 35*a* formed on a posterior end (at right side) of the bin 35, by a mechanism described later. Thereby, as shown by a solid line in FIG. 15, the paper P on the bin 35 can be nipped between a pair of upper and lower rollers 65 and 66 at both sides.

Each pack unit 46 is attached to a pack bracket 69 shown in FIG. 6, and is configured to be swingable, together with the pack bracket 69, about a shaft 71 of the pack bracket 69 in a direction of an arrow F, until the position shown by a virtual line in FIG. 6. The pair of pack units 46 is provided to come close to or apart from each other by a mechanism using a rack and a pinion (not shown in drawings) and can be moved away from or close to the notched portions 35*b* and 35*c* of the bin 35 shown in FIG. 14. The upper roller 65 and the lower roller 66 come close to or apart from each other, when the upper and lower pack sections 63 and 64 shown in FIG. 6 are closed or opened.

When the paper. P is discharged to the bin 35, the pack units 46 function as a side jogger, which positions the paper on the basis of the center, by approaching each other to sandwich the paper therebetween from both sides. The pack units 46 make the upper and lower rollers 65 and 66 approach each other and nip the paper between the upper and lower rollers 65 and 66, rotate the upper and lower rollers 65 and 66 in a direction to move the paper toward the bin fence 35*a*, move the paper until the end of the paper bumps into the bin fence 35*a*, and align the end of the paper, i.e., also function as an end jogger.

Figure 16:
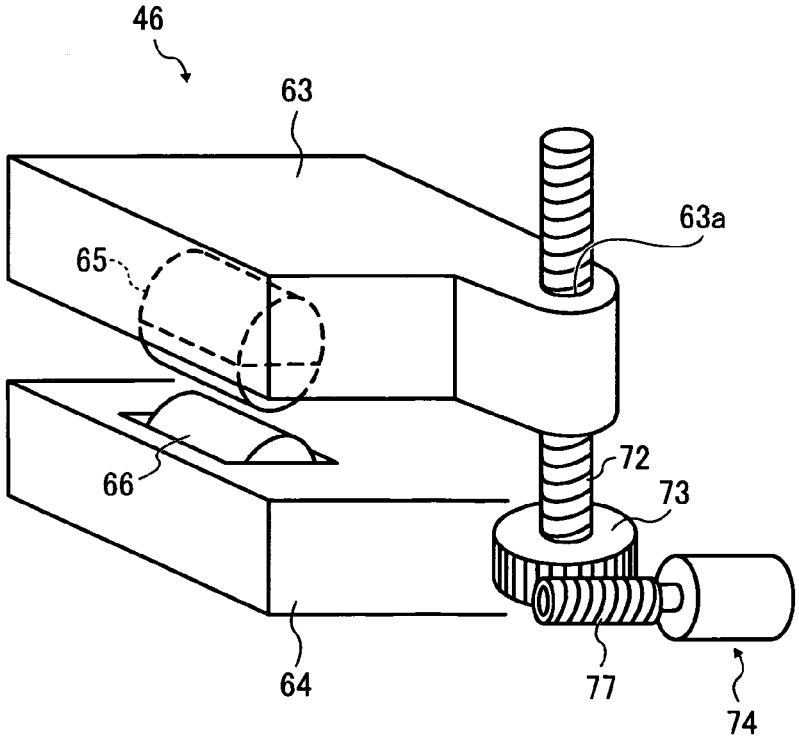
FIG. 16 is a perspective view showing a main portion of the pack unit.

FIG. 16 is a perspective view illustrating a main portion of the pack unit 46. As shown in FIG. 16, the upper roller 65 is integrated in the upper pack section 63 and exposes only the lower portion of the upper roller 65. The lower roller 66 is integrated in the lower pack section 64 and exposes only the upper portion of the lower roller 66. The upper pack section 63 has a protruding portion on a side. A female screw 63*a* is formed in the portion in a vertical direction. A vertical feed screw 72 is screwed into the female screw 63*a*.

Figure 17:
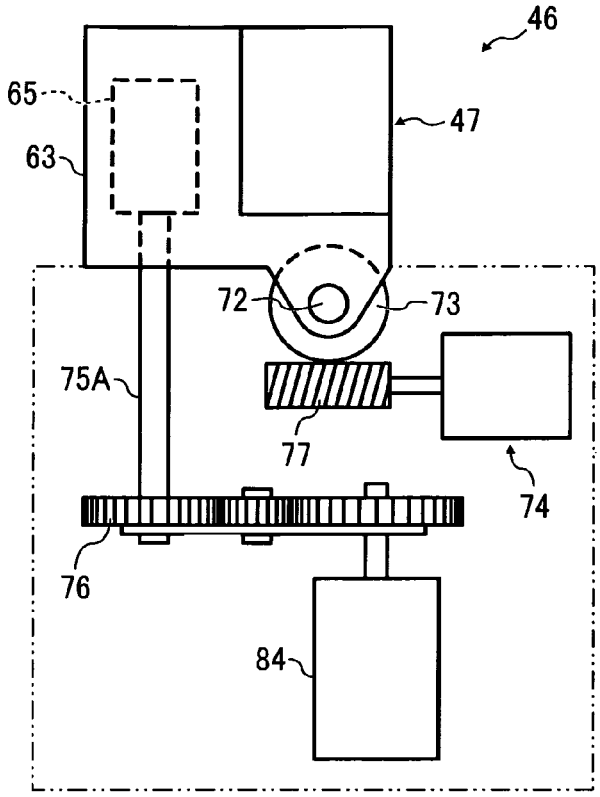
FIG. 17 is a plan view showing the pack unit.

A worm wheel 73 is fixed to a lower end of the vertical feed screw 72, and a worm 77 that is fixed to a rotation shaft of a forward/backward rotatable motor 74 is engaged with the worm wheel 73 as shown in FIG. 17. Although not shown in FIG. 16, the vertical feed screw 72 is rotatably supported by the lower pack section 64. Therefore, when the motor 74 rotates in forward and backward directions, the upper pack section 63 moves vertically together with the upper roller 65.

Figure 18:
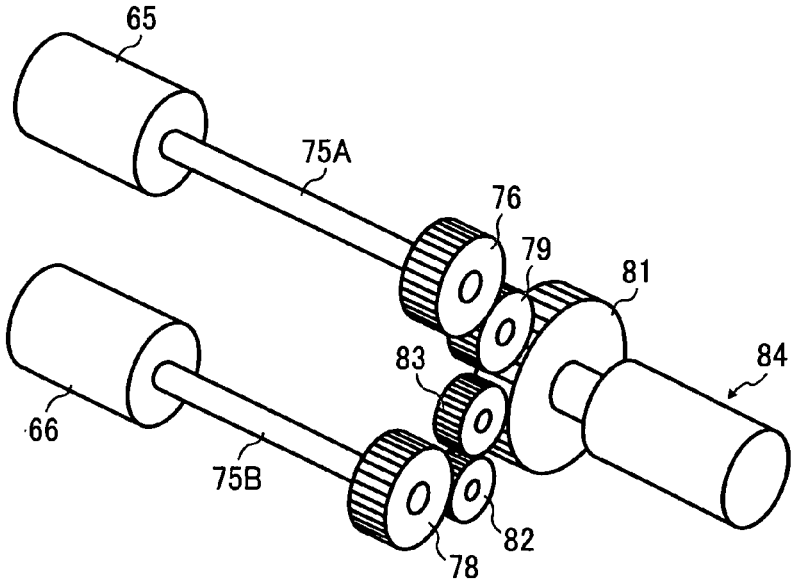
FIG. 18 is a perspective view showing a driving system for driving upper and lower rollers of the pack unit.

As shown in FIGS. 17 and 18, the upper roller 65 is fixed to one end of the rotation shaft 75A and the rotation shaft 75A is rotatably mounted onto the upper pack section 63. Likewise, as shown in FIG. 18, the lower roller 66 is fixed to one end of a rotation shaft 75B and the rotation shaft 75B is rotatably mounted onto the lower pack section 64 (refer to FIG. 16).

As shown in FIG. 18, a gear 76 is fixed to the other end of the rotation shaft 75A and a gear 78 is fixed to the other end of the lower rotation shaft 75B. The gear 76 is engaged with an intermediate gear 79 and the intermediate gear 79 is engaged with a driving gear 81.

Meanwhile, the gear 78 of the lower roller 66 is engaged with an intermediate gear 82 and the intermediate gear 82 is engaged with an intermediate gear 83 and the intermediate gear 83 is engaged with the driving gear 81. The driving gear 81 is fixed to an output shaft of a chuck motor 84. Since the numbers of teeth are the same between the gear 76 and the gear 78, the gear 76 and the gear 78 always rotate at the same rotation number in directions reverse to each other by rotation of the chuck motor 84.

Figure 14:
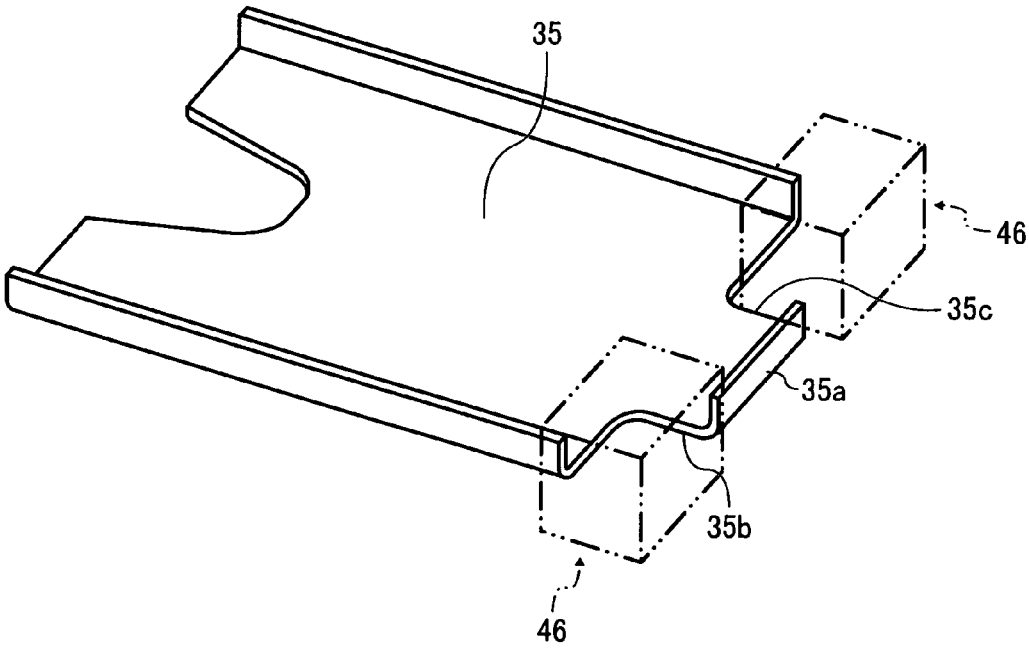
FIG. 14 is a perspective view showing a positional relationship of a pack unit and a bin provided as a pair in the SSP unit.
Figure 19:
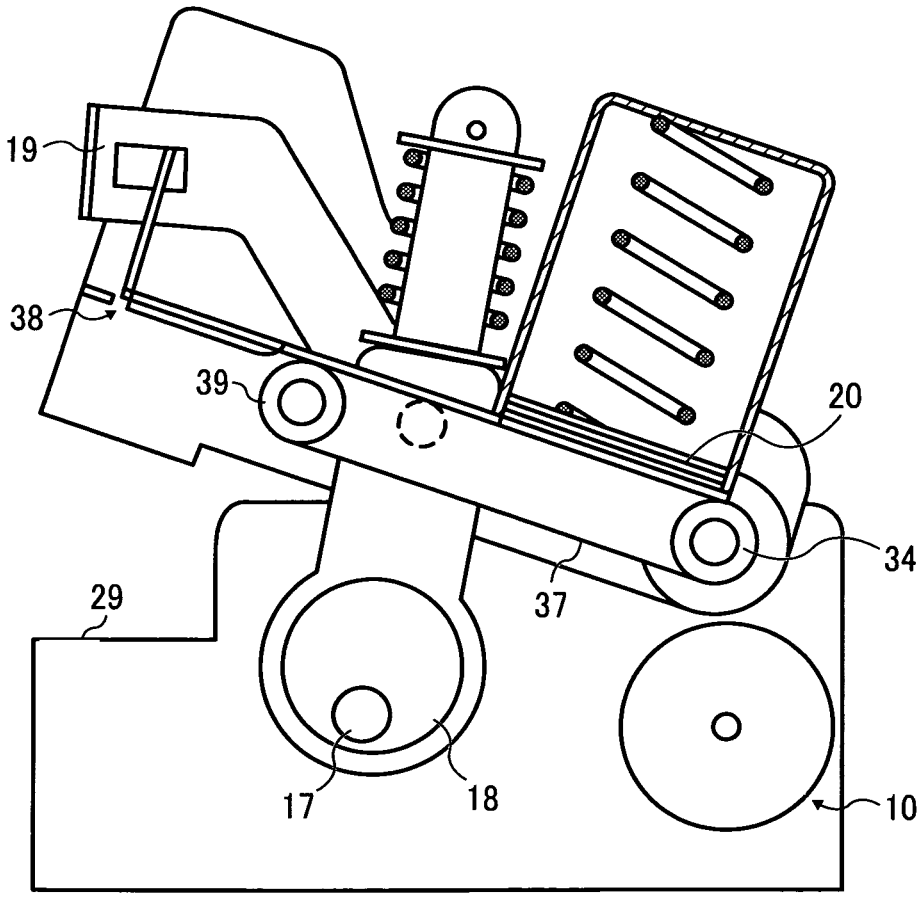
FIG. 19 is a diagram showing the configuration of a stapler that is provided in the SSP unit.

As simply shown in FIG. 17, in the pack unit 46, the stapler 47 is mounted integrally at a position near the bin fence 35*a* (refer to FIG. 14). The stapler 47 beats a staple driver 19 by rotation of an eccentric cam 18 rotating around a shaft 17 connected with a staple motor 10 shown in FIG. 19 via a deceleration gear not shown in the drawings, thereby beasts a staple 20, which is moved at a staple exit 38, to be inserted into the paper, etc., bends the tips of the staple by a seat 29, and finishes a staple operation.

The staple 20 is moved to the staple exit 38 by rotation of a feed belt 37. The feed belt 37 is stretched between a feed pulley 34, to which the rotation force of the staple motor 10 is transmitted through the deceleration gear (not shown in drawings), and a pulley 39.

Figure 20:
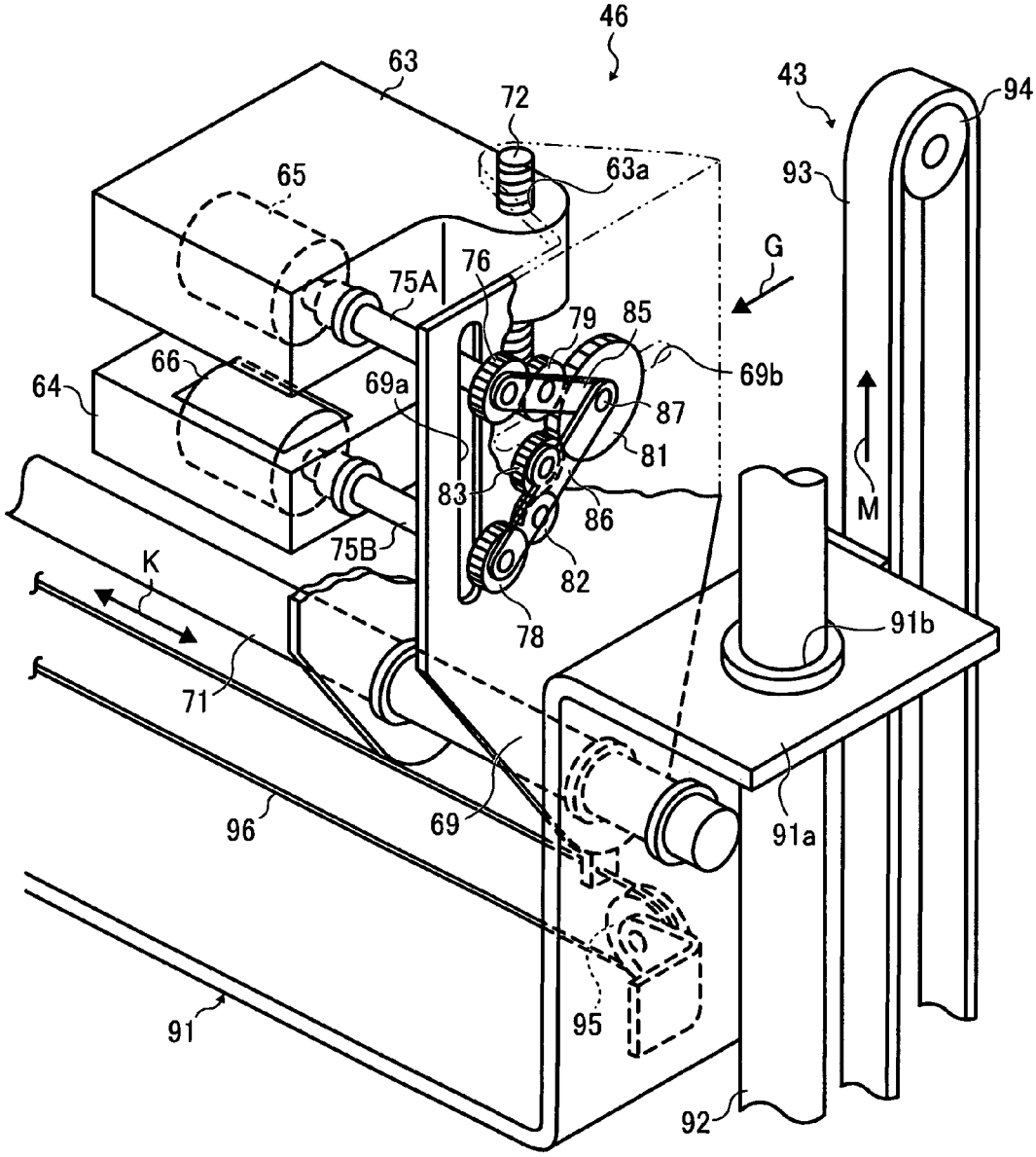
FIG. 20 is a perspective view showing a driving system for moving the SSP unit and the pack unit.

FIG. 20 is a perspective view illustrating a driving system that moves the SSP unit 40 and the pack unit 46. As shown in FIG. 20, rotation shafts 75A and 75B that support the upper and lower rollers 65 and 66, respectively, are movably fitted in a vertical guide groove 69*a* that is formed in a vertical surface of the pack bracket 69, and a group of gears that are engaged with the gear 76 fixed to one end of the rotation shaft 75A, that is, the intermediate gear 79 and the driving gear 81 are rotatably supported by an upper gear support plate 85 together with the gear 76, so that the rotation force from the driving gear 81 is smoothly transmitted to the gear 76.

The intermediate gears 82 and 83 and the driving gear 81 that are engaged with the gear 78 fixed to one end of the lower rotating shaft 75B and the gear 78 are rotatably supported to a lower gear support plate 86, similar to the above case, and the rotating force from the driving gear 81 is smoothly transmitted to the gear 78.

The driving gear 81 rotates in forward and backward directions by the forward/backward motor 84 shown in FIG. 18 and the shaft 87 that fixes and supports the central portion thereof is movably fitted into a horizontal guide groove 69*b* that is formed in the pack bracket 69.

Therefore, in the pack unit 46, if the motor 74 (refer to FIG. 16) that is mounted to the pack bracket 69 is rotated, the vertical feed screw 72 rotates through the worm 77 and the worm wheel 73, and the upper pack unit 63 of which the female screw 63*a* is engaged with the vertical feed screw 72 moves vertically.

At this time, when the gear 76 ascends, the gear 76 and the driving gear 81 are connected by the upper gear support plate 85. Therefore, the driving gear 81 moves in a direction of an arrow G in the horizontal guide groove 69*b*. As a result, the lower gear 78 that is connected to the driving gear 81 by the lower gear support plate 86 moves downward in the vertical guide groove 69*a*, and the rotating shaft 75B and the lower roller 66 descend.

When the motor 74 rotates in a direction in which the upper pack unit 63 descends, the upper and lower gears 76 and 78 come close to each other and the driving gear 81 moves in a direction opposite to the direction of the arrow G, different from the above case.

The pack unit 46 fits the shaft 71 into the lower portion of the pack bracket 69 in a horizontal direction and is configured to move in a direction of an arrow K along the shaft 71, and the other pack unit 46 (refer to FIG. 15) facing one pack unit can be moved.

Both ends (only the single side is shown in FIG. 20) of the shaft 71 are fixed to a moving frame 91. In the moving frame 91, a hole 91*b* that is formed in an extending portion 91*a* of both ends is fitted into a guide rod 92 that is vertically fixed to the fixing portion of the device body of the SSP device 3, and one side edge of the extending portion 91*a* is fixed to a part of an endless driving belt 93 that is stretched between upper and lower pulleys 94 (only the upper side is shown in FIG. 20) constituting the elevating device 43 rotatably mounted to the fixing portion of the device body of the SSP device 3.

Therefore, the pack unit 46 moves vertically integrally with the moving frame 91 by rotating the driving belt 93 in forward and backward directions, the sort guide section 44 and the envelope chuck section 45 shown in FIG. 6 are attached to the moving frame 91 through the frame 51 (or may be directly attached), and thus all of these are integrally moved in a vertical direction.

In the pack unit 46, the pack bracket 69 can rotate, i.e., swing by a predetermined angle in a direction of an arrow F of FIG. 6 about the shaft 71, up to a position shown by a virtual line.

A mechanism that swings the pack bracket 69 can be easily configured by those who are skilled in the art, for example, as a mechanism in which one end of a link rod connected to a rotation plate fixed to a rotation shaft of a motor and linearly moving is connected to the pack bracket 69 by a ball joint, moves the link rod, and the pack bracket 69 is rotated about the shaft 71 by moving the link rod, or a mechanism in which a spline is formed in the shaft 71 across all of a range where the pack bracket 69 moves, a sparring gear is fixed to an end of the shaft, and the pack bracket 69 is rotated by transmitting driving force to the gear and rotating the shaft 71.

The movement of the pack unit 46 in a direction of an arrow K in FIG. 20 is made by a driving wire 96 that is stretched between pulleys 95 (in FIG. 20, only one of the pulleys is shown) rotatably attached to both ends in the moving frame 91, a part of the wire 96 is fixed to the lower end of the pack bracket 69, and the wire 96 is rotated in forward and backward directions by a jogger motor not shown in the drawings.

A configuration where a predetermined pressure is applied to the paper according to the shapes and the materials of the upper and lower rollers 65 and 66 and the outer diameters of the upper and lower rollers 65 and 66, and the paper is conveyed to be positioned at the "feed mode position", is the same as the technical content shown in FIGS. 21 to 24 of Japanese Patent Nos. 3110804 and 3110806 and described in the paragraphs [0068] to [0070] of Japanese Patent No. 3110804. Therefore, the detailed description is omitted.

Meanwhile, the positions of the upper roller 65 and the lower roller 66 include the "jog mode position" in addition to the above-described "feed mode position". Each position is determined by the positions of the upper pack section 63 and the lower pack section 64 of FIG. 16 and is determined by the rotation amount of the motor 74.

The "jog mode position" and the "feed mode position" change depending on the number of paper on the bin 35. The optimal position is always obtained by reading out data indicating a relationship between the corresponding rotation amounts of the motor 74 and the various numbers of paper stored in a ROM 132 (refer to FIG. 33) of the control device 120.

Figure 21:
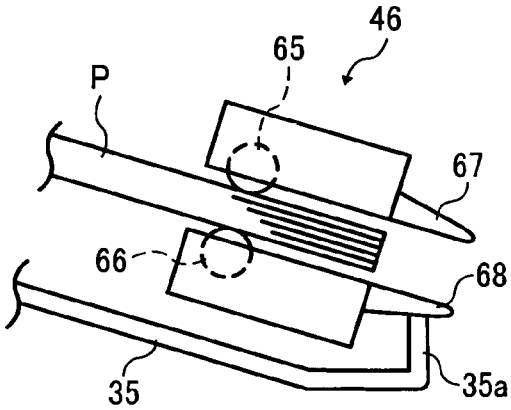
FIG. 21 is a front view of a main portion showing a state where a bottom surface of the paper nipped by the pack unit is ascended to the position crossing over an upper end of a bin fence.
Figure 22:
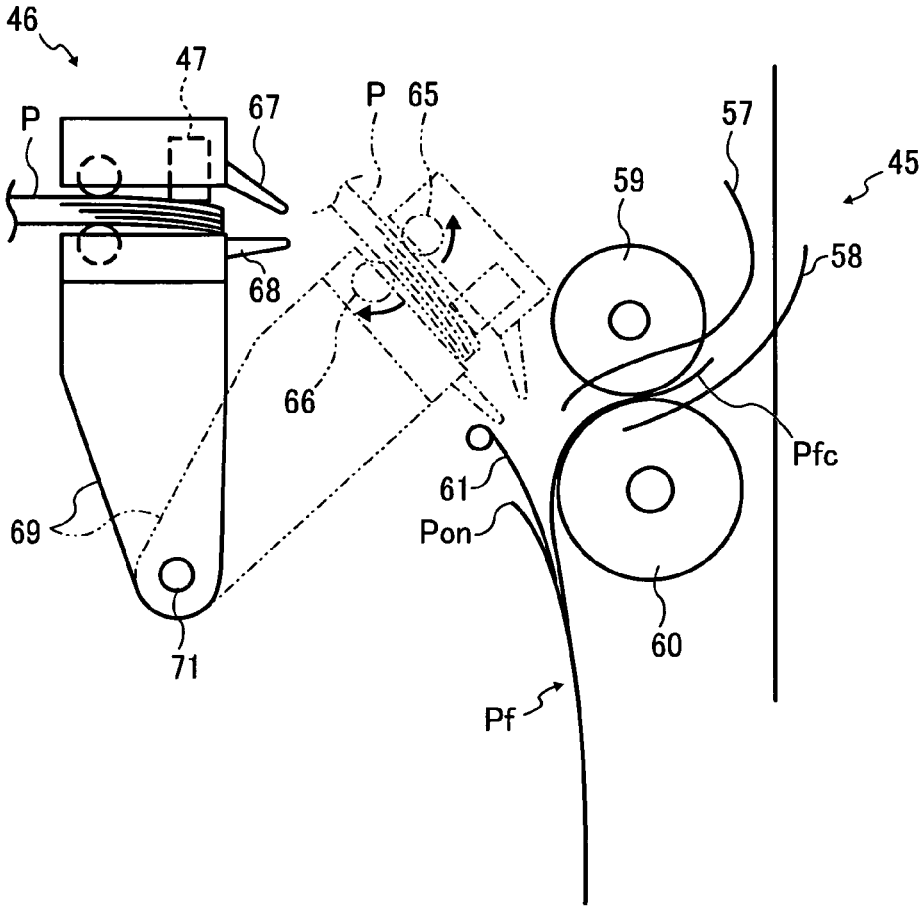
FIG. 22 is a front view showing an aspect where the pack unit nips the paper and moves to the insertion position of the paper in the envelope.
Figure 23:
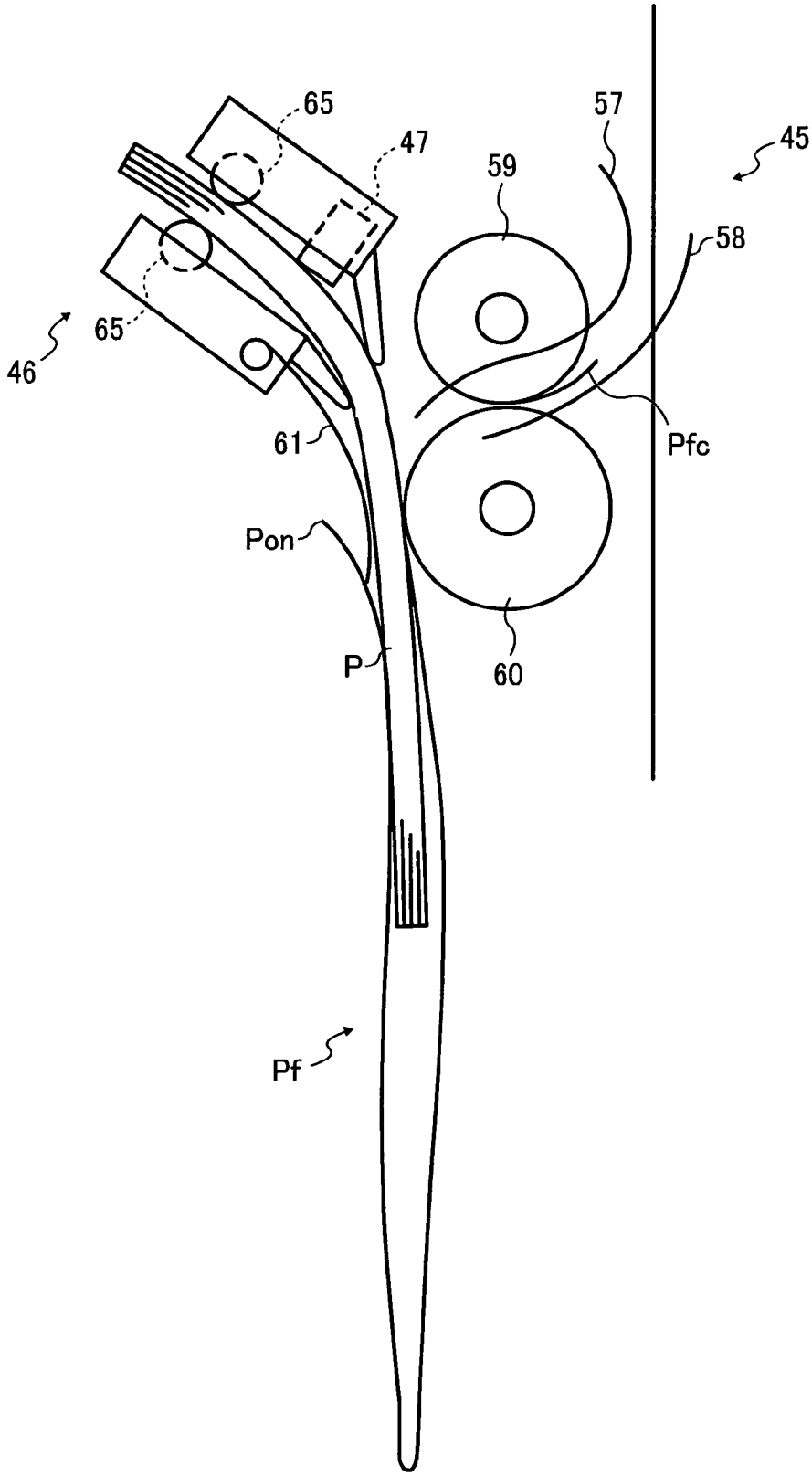
FIG. 23 is a front view showing an aspect where the paper nipped by the pack unit is inserted into the envelope.

Referring to FIGS. 21 to 23, an enclosing mechanism that includes an enclosing unit to enclose a mailable content in the envelope will be described. Hereinafter, "paper" is described as a representative of the mailable content.

Figure 15:
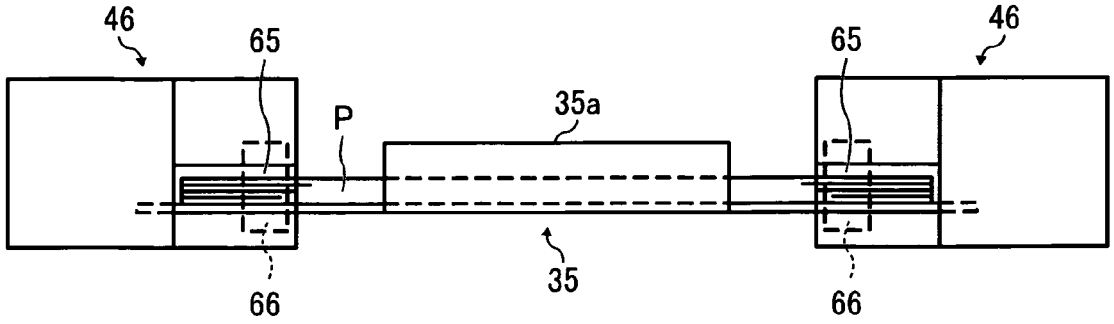
FIG. 15 is a side view showing a positional relationship of the pack unit and the bin.

When a pack mode (also called envelope enclosing mode) where the paper is included or enclosed in the envelope is selected, the upper and lower rollers 65 and 66 of respective pack units 46 are moved toward each other to nip the paper P (paper bundle when the paper is stapled and bound) therebetween by rotating the motor 74 (refer to FIG. 16) when the pack units 46 are located at a position shown in FIG. 15.

Next, the driving belt 93 shown in FIG. 20 is rotated in a direction of an arrow M to lift the pack unit 46. This lifting is stopped when the bottom surface of the nipped paper P is raised beyond the upper end of the bin fence 35*a* of the bin 35 as shown in FIG. 21.

Then, as shown in FIG. 22, the pack unit 46 is swung about the shaft 71 to move the insertion guides 67 and 68 at a forward side to the opening Pon of the envelope Pf in a state where the opening Pon is opened in the envelope chuck section 45, as described in FIGS. 12 and 13. The insertion guides 67 and 68 are moved to an upper portion of the envelope opening mylar 61 or in an inside of the opening Pon of the envelope.

In this state, the upper and lower rollers 65 and 66 of the pack unit 46 are rotated in a direction (feed direction) of an arrow in FIG. 22, and the paper P nipped therebetween is inserted into the envelope Pf, as shown in FIG. 23.

As such, in this embodiment, the envelope Pf is guided by the envelope guides 57 and 58 to the position where the paper P is fed, and the guided envelope Pf is held by the pair of chuck rollers 59 and 60. After the side of the lower end 61*a* of the opening mylar 61 is inserted into the opening Pon of the envelope Pf in the holding state and the opening Pon is opened, the paper P that is fed by the pack unit 46 is inserted into the opening Pon of the envelope Pf.

Next, the characteristic technical contents of this embodiment will be described in detail.

Figure 24A:
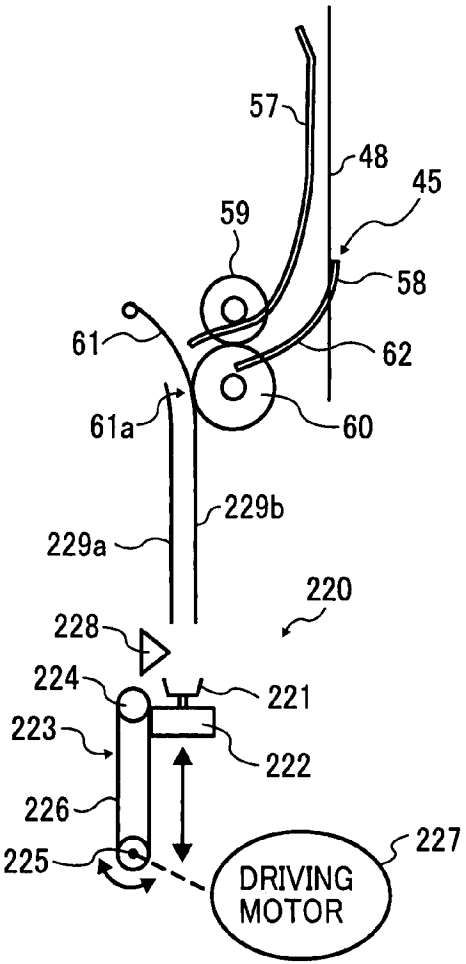
FIGS. 24A to 24C are front views showing the configuration of a weight measuring device and an operation transition of when the weight of the envelope is measured.
Figure 24B:
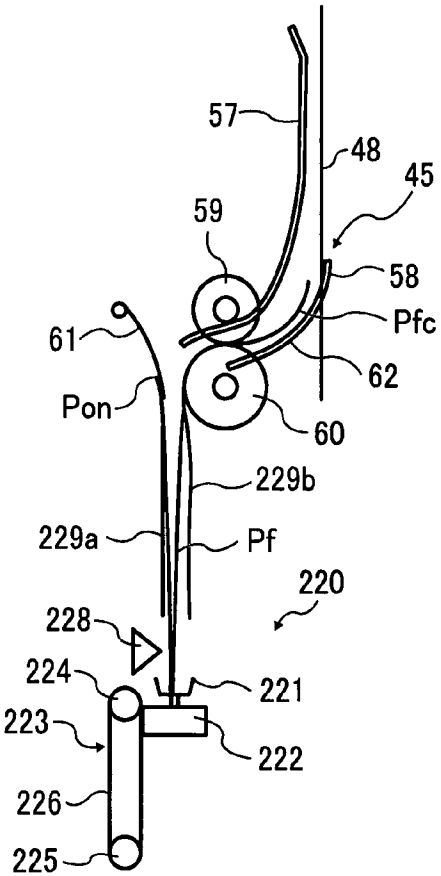
Figure 24C:
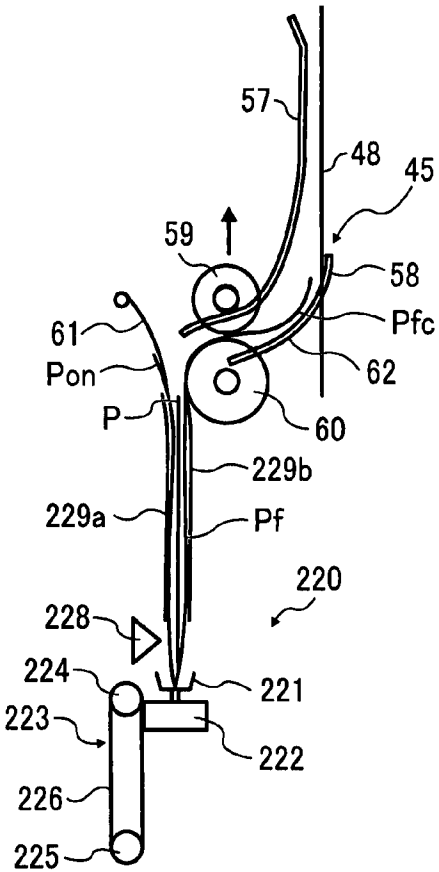
Figure 25:
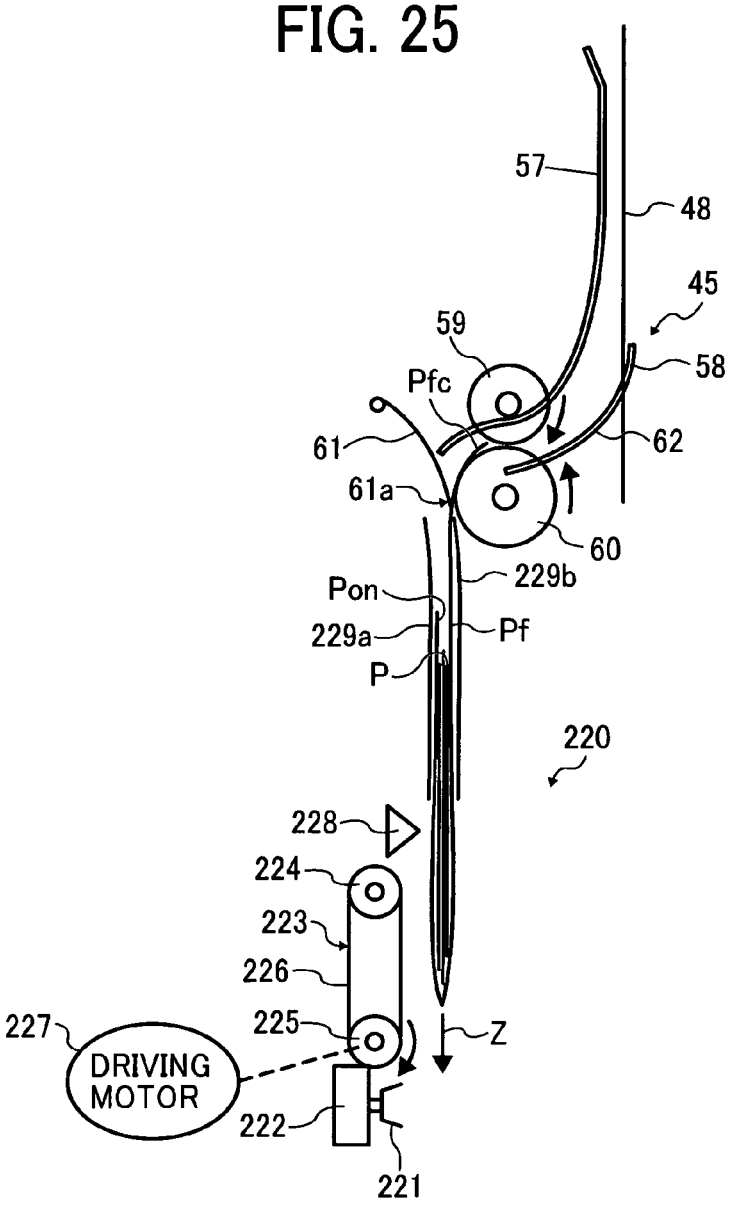
FIG. 25 is a front view showing the configuration of the weight measuring device and an operation transition of when the weight of the envelope is measured, following FIGS. 24A to 24C.
Figure 31:
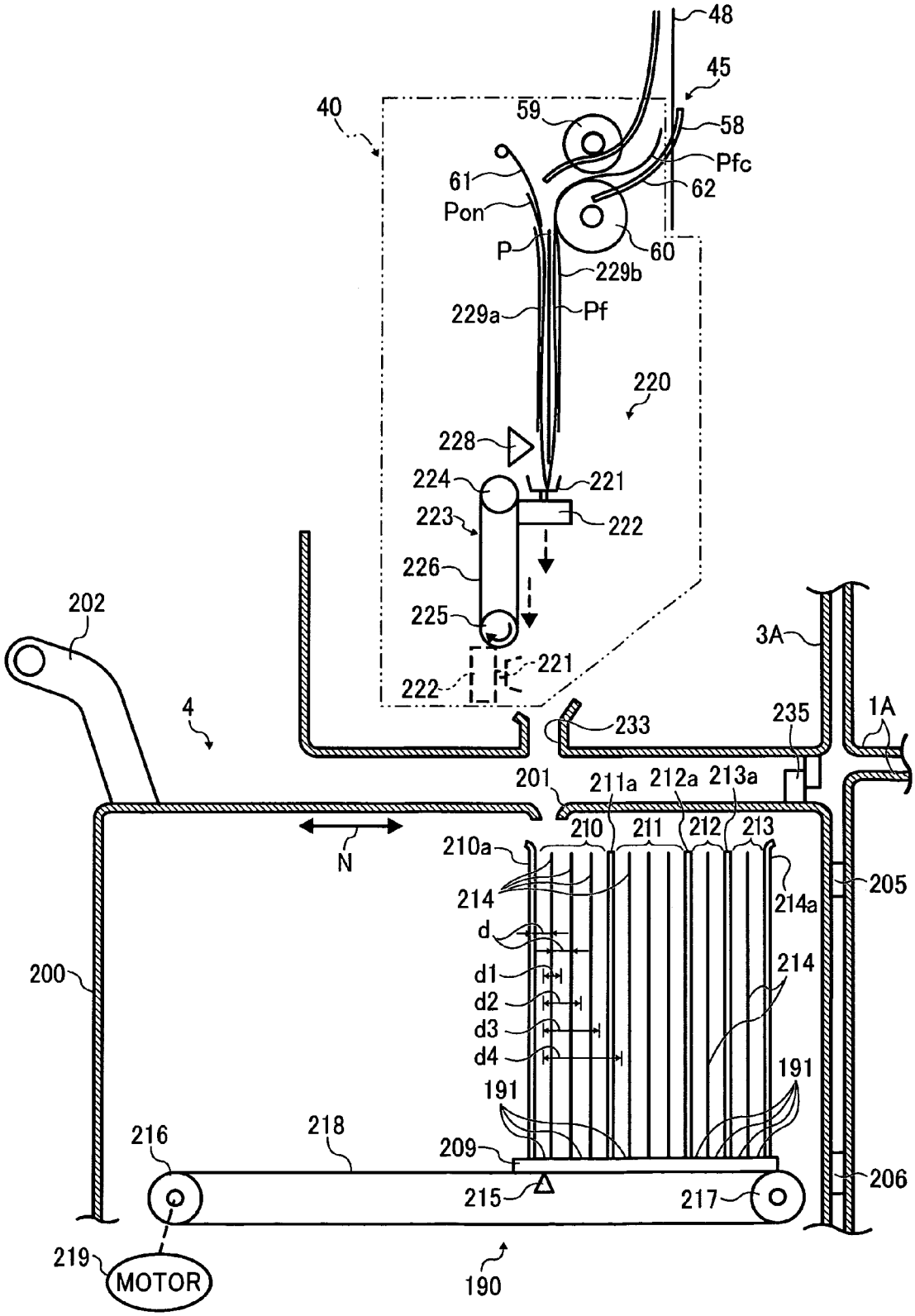
FIG. 31 is a cross-sectional view of a relevant portion showing the weight measuring device provided in an enclosing portion of the SSP unit and a sorting device in a storage carrier 4.
Figure 33:
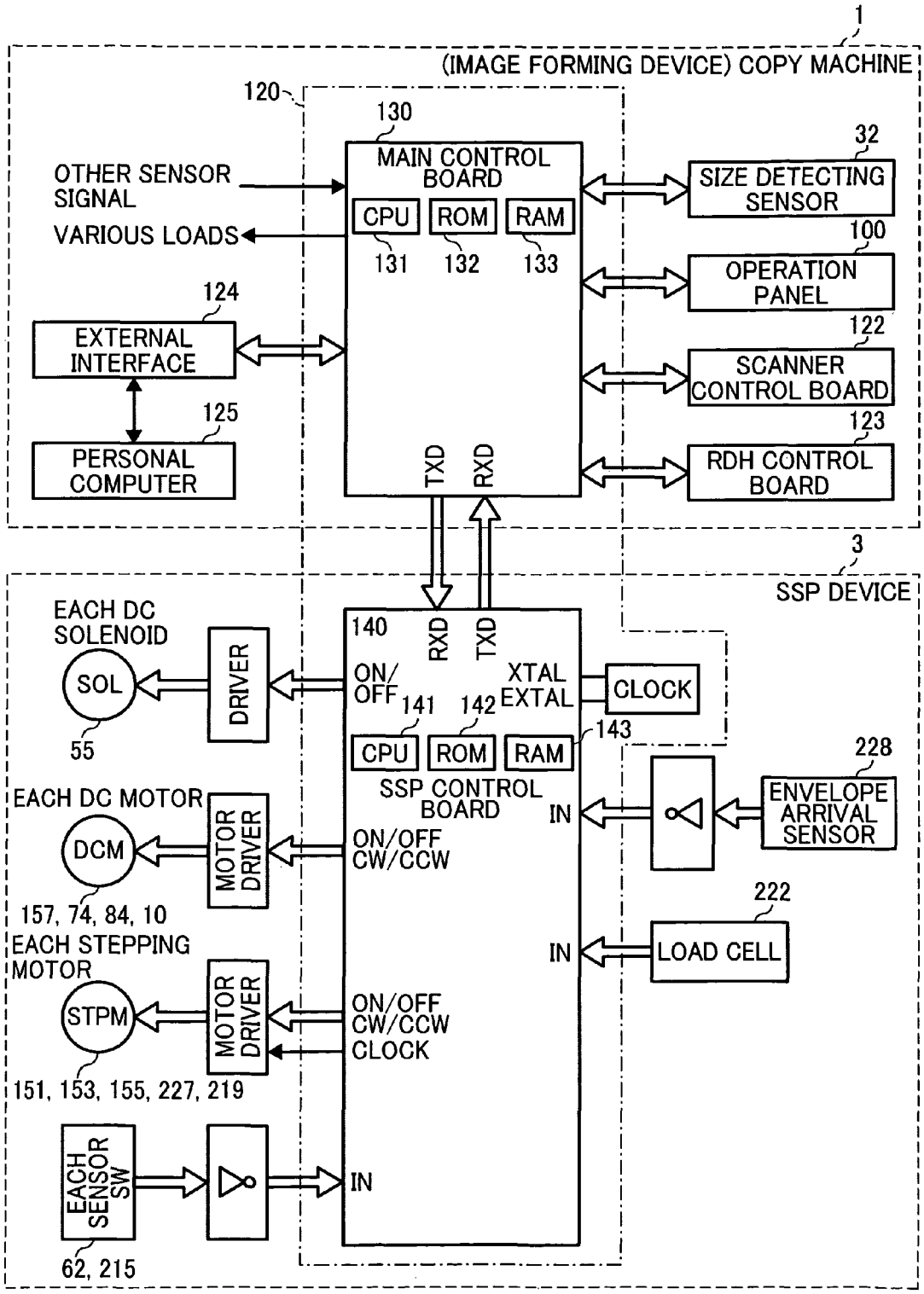
FIG. 33 is a block diagram showing a control device to perform whole control of the image forming system of the digital copy machine and the SSP device in FIG. 1 and the association configuration thereof.

According to the characteristic of this embodiment, the image forming system includes the weight measuring unit (refer to a weight measuring device 220 of FIGS. 24A to 24C to be described below) that measures the weight of the paper-enclosed envelopes made by the SSP unit 40 (an envelope chuck section 45 and a pack unit 46) that is the enclosing unit or the enclosing device, the sorting unit (refer to the internal configuration of a storage carrier 4 of FIG. 31 to be described below) that sorts the paper-enclosed envelopes, on the basis of the weight data of each of the paper-enclosed envelopes measured by the weight measuring unit, the discharging unit (refer to a pair of chuck rollers 59 and 60 of the envelope chuck section 45 and a vertical moving mechanism 223 of FIGS. 25 and 31 to be described below) that discharges, to the sorting unit, the paper-enclosed envelopes of which the weight is measured by the weight measuring unit, the loading unit (refer to the internal configuration of the storage carrier 4 of FIG. 31 to be described below) that loads the paper-enclosed envelopes discharged by the discharging unit, and the control device 120 of FIG. 1 and FIG. 33 (to be described below) that functions as the sorting control unit to control the sorting unit to sort the paper-enclosed envelopes, on the basis of the weight data of each of the paper-enclosed envelopes output from the weight measuring unit.

First, referring to FIGS. 24A to 29, the weight measuring device 220 that measures the weight (mass) of the paper-enclosed envelope and the control configuration thereof will be described. FIGS. 24A to 25 show the configuration of the weight measuring device 220 to measure the weight (mass) of the paper-enclosed envelope (hereinafter, simply referred to as "envelope", when the paper is completely enclosed) according to this embodiment and an operation transition of when the weight of the envelope is measured. In FIGS. 24A to 25, the pack unit 46 shown in FIG. 23 is not omitted to clarify the configuration.

The weight measuring device 220 has the configuration that is called a weight measuring mechanism, as shown in FIGS. 24A to 26. The weight measuring device 220 mainly includes an envelope fence 221 that carries a paper-enclosed envelope, a load cell 222 that functions as a weight measuring unit and a weight detecting unit attached to the lower portion of the envelope fence 221, a vertical moving mechanism 223 that vertically moves the load cell 222 together with the envelope fence 221 to the setting position where the weight can be measured (or setting position), according to the size of the envelope (mainly the length of the envelope), and a nip pressure releasing/applying mechanism that releases or applies the nip pressure of the pair of chuck rollers 59 and 60 (broadly defined configuration).

The weight measuring device 220 may have the narrowly defined configuration where an envelope arrival sensor 228 and a pair of side plates 229*a* and 229*b* to be described below are added to the broadly defined configuration.

The load cell 222 is a sensor that converts the force (mass or torque) into an electric signal and outputs the electric signal. As the load cell 222, plural distortion gauges may be bonded or a semiconductor may be configured as a converting element. As the load cell 222, a load cell that has sensitivity and a measurement range allowing the total weight of the "paper enclosed envelope" to be measured is selected in this embodiment.

The vertical moving mechanism 223 mainly includes a driven pulley 224 and a driving pulley 225 of a pair that are rotatably supported to the frame 51 (refer to FIG. 6), an endless belt 226 which is stretched between the pulleys 224 and 225 and to which a non-measurement portion of the load cell 222 is adhered, and a driving motor 227 (refer to FIG. 24A) that is connected to the driving pulley 225 through a driving transmitting unit such as a gear not shown in the drawings. In the drawings other than FIG. 24A, the driving motor 227 is not shown to simplify and clarify the configuration.

In this embodiment, as shown in FIGS. 25 and 31, the load cell 222 is positioned and maintained at the setting position by the vertical moving mechanism 223 including the belt 226 to which the load cell 222 is adhered, and the weight is measured. Then, as described above, the sorting control is executed on the basis of the weight data of each of the paper-enclosed envelopes. For this reason, sorting is enabled by the sorting unit and the paper-enclosed envelope of which the weight is measured needs to be discharged. Therefore, the function as the discharging unit that discharges the paper-enclosed envelope of which the weight is measured by the load cell 222 to the sorting unit in the storage carrier 4 shown in FIG. 31 is given to the single vertical moving mechanism 223.

In FIG. 25, when the paper-enclosed envelope Pf of which the weight is measured is discharged to the sorting unit in the storage carrier 4 shown in FIG. 31, the envelope fence 221 and the load cell 222 need to be moved to the evacuation position below the vertical moving mechanism 223, such that the paper-enclosed envelope Pf is carried in a vertical direction Z and can be smoothly discharged, that is, the envelope Pf is not hooked to the envelope fence 221 and the load cell 222 during the falling of the envelope Pf.

Figure 26:
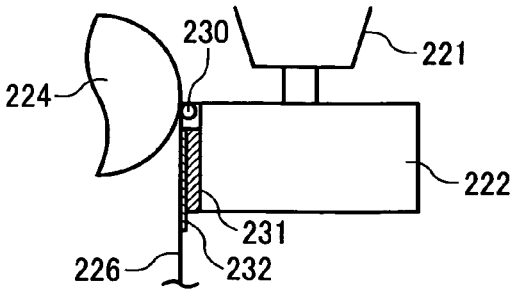
FIG. 26 is an enlarged cross-sectional view of a main portion of the weight measuring device.

As shown in FIG. 26, a mechanism that selectively holds the left side of the load cell 222 to the belt 226 is provided. In FIG. 26, an upper end of the left side of the load cell 222 is supported to the belt 226 through a shaft 230 to swing. To a lower end of the left side of the load cell 222, a magnet 231 that is selectively absorbed and held in a ferromagnetic material 232 made of reticular flexible iron adhered to the belt 226 is mounted and fixed.

Thereby, as shown in FIGS. 24A to 24C, the envelope fence 221 is disposed at the setting position or the surrounding positions thereof, the magnet 231 of the load cell 222 is absorbed into and held in the ferromagnetic material 232 of the belt 226 with the appropriate magnetic force, and the load cell 222 takes the posture of the weight measurement. When the paper-enclosed envelope Pf of which the weight is measured is discharged to the sorting unit in the storage carrier 4 shown in FIG. 31, the belt 226 travels in a clockwise direction, overcomes the magnetic attracting force of the magnet 231 and the ferromagnetic material 232 by the curvature of the driving pulley 225, as shown by a solid line in FIG. 25 and a broken line in FIG. 31, and the load cell 222 is supported to the belt 226 at only a portion of the shaft 230 and can occupy the evacuation position. The holding mechanism of the load cell 222 with respect to the belt 226 may use the magic tape (registered trademark), instead of the selective holding of the magnetic attracting force of the magnet 231 and the ferromagnetic material 232.

The driving motor 227 is adhered to the frame 51 (refer to FIG. 6). As the driving motor 227, a stepping motor that is driven by a pulse input suitable for control to vertically move the load cell 222 together with the envelope fence 221 by the predetermined moving amount according to the size of the envelope Pf through the driving pulley 225 and the belt 226 is preferably used. In order to accurately perform the control, the initial position where the envelope fence 221 is maintained in a standby state to be described below is previously determined according to the size (vertical length) of the envelope becoming a reference, and a home position sensor that detects the initial position is preferably disposed.

The pair of chuck rollers 59 and 60 is configured to release the nip pressure by the nip pressure releasing/applying mechanism (not shown in the drawings) including a pressure-contact releasing unit to release the pressure-contact with respect to the envelope. In a state where the nip pressure of the pair of chuck rollers 59 and 60 is released by the nip pressure releasing/applying mechanism (in this case, the nip pressure is released in a state where the chuck roller 59 is apart from the chuck roller 60), the paper-enclosed envelope is carried on the envelope fence 221 mounted to the load cell 222. In a state where frictional resistance externally applied to the paper-enclosed envelope from the outside is maximally excluded, only the weight (mass) of the paper-enclosed envelope is measured.

As the nip pressure releasing/applying mechanism (not shown in the drawings), a "pressure applying/releasing mechanism of a first sheet feeder" that is shown in FIG. 6 of Japanese Patent Application Laid-open No. 2009-58763 suggested by the inventors is preferable.

On the lower side between the lower chuck roller 60 and the lower end 61*a* of the opening mylar 61, a pair of side plates 229*a* and 229*b* that functions as a mail (envelope) guiding member to surely guide the lower end of the envelope of the side opposite to the flap Pfc of the envelope Pf to the envelope fence 221 is disposed. The pair of side plates 229*a* and 229*b* is adhered to the frame 51 (refer to FIG. 6) and are disposed in parallel to extend a vertical direction and a depth direction of a plane of paper (width direction and horizontal direction of the envelope Pf or the paper). The pair of side plates 229*a* and 229*b* enters in a communication state where upper and lower ends thereof are opened, and is formed such that the envelope Pf is dropped by the self weight and the lower end thereof is guided to be carried to the envelope fence 221. The pair of side plates 229*a* and 229*b* is preferably formed of a material that does not apply the frictional resistance to the envelope Pf to enable accurate weight measurement, that is, a thin metal plate that has the small frictional coefficient with respect to the envelope Pf and easily discharges the generated static electricity.

The envelope arrival sensor 228 detects the arrival of the envelope Pf passed through the pair of side plates 229*a* and 229*b* at the envelope fence 221, and the arrival is used as the trigger of the weight measurement start based on the load cell 222. For example, there is used a reflective photo sensor or a transmissive photo sensor to which a light shielding piece (filler) is attached.

The operation of the weight measuring device 220 in the enclosing portion where the enclosing device exists will be described with reference to a flowchart of FIG. 27.

Figure 32A:
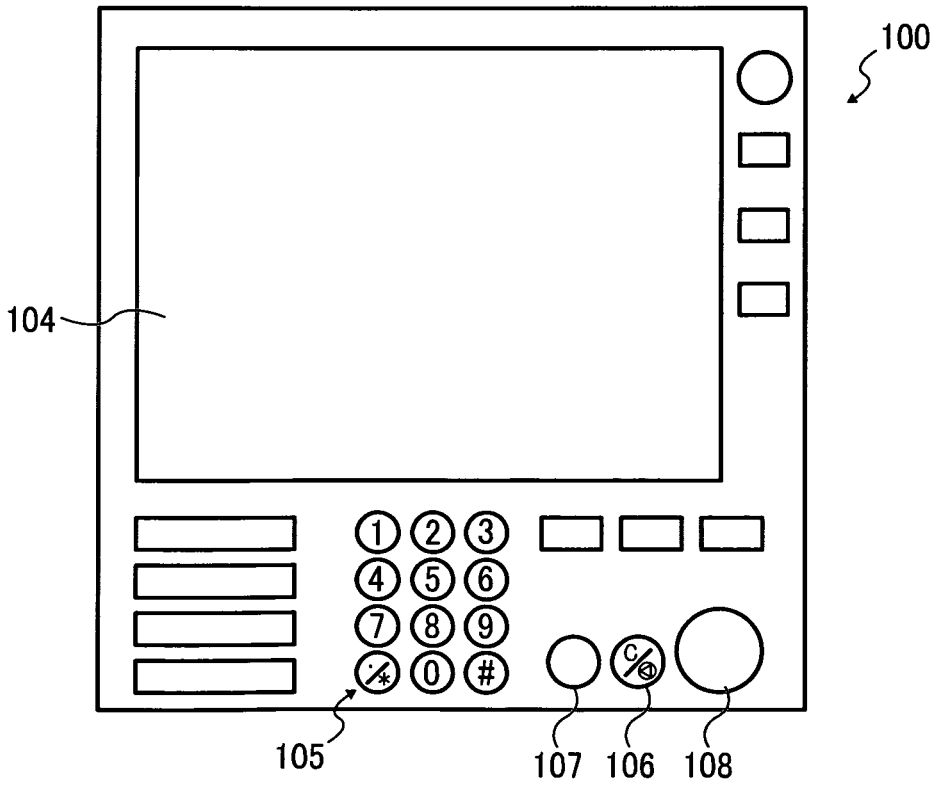
FIG. 32A is a plan view of an operation panel that is provided in the digital copy machine of FIG. 1.
Figure 32B:
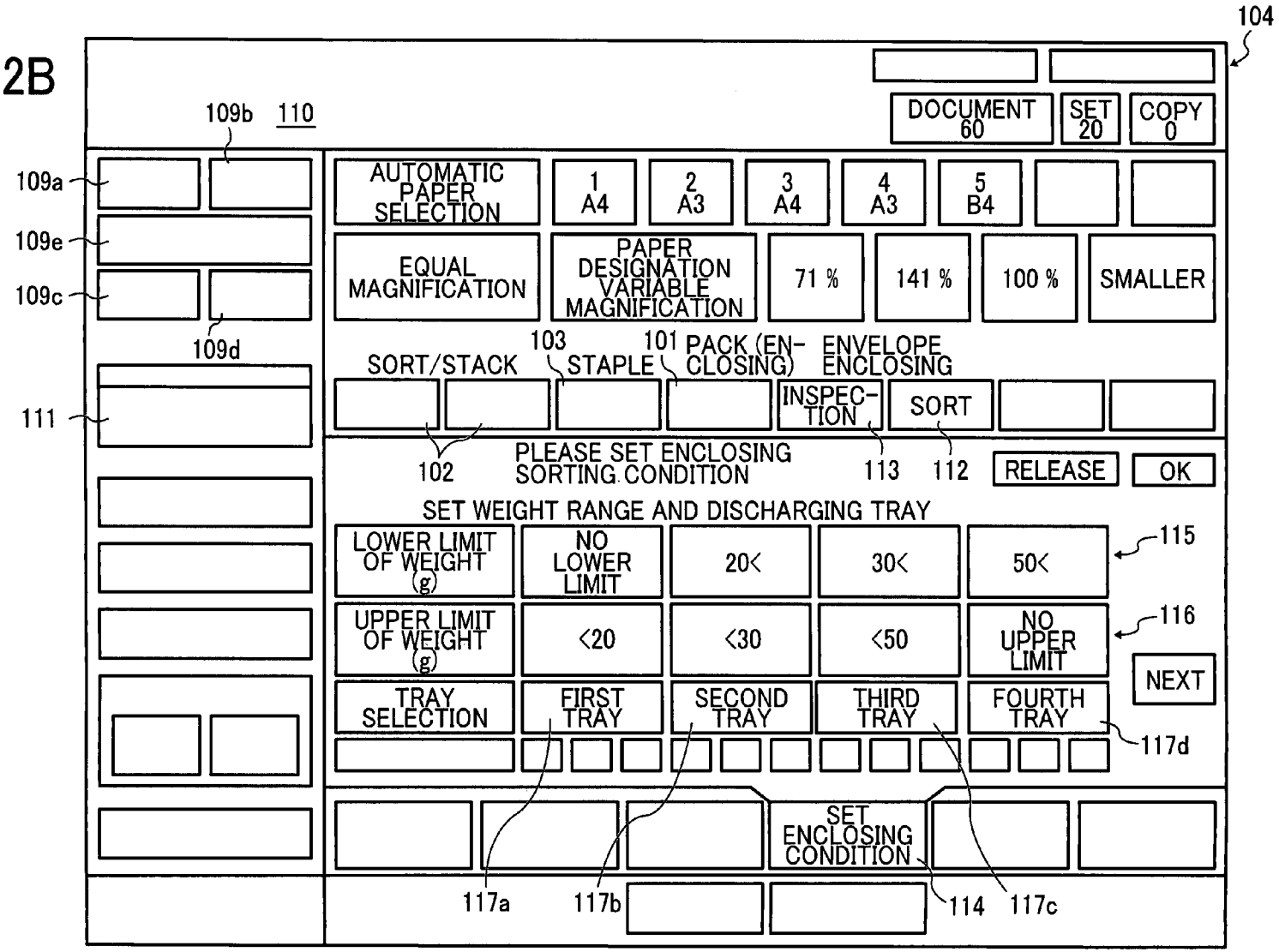
FIG. 32B is an enlarged plan view of a display unit of the operation panel.

First, a user presses a package key 101 of a touch panel display unit 104 shown in FIG. 32B to set an enclosing mode (an envelope enclosing mode or pack mode), an the enclosing mode is selected (stat of the enclosing mode). Next, if the user presses any one of paper/envelope selection keys 109*a* to 109*d* shown in FIG. 32B and selects the envelope tray (for example, refer to feed cassette 15A or tray 24 of FIG. 1) where the envelopes are stored (step S1), a job that is related to the enclosing mode starts (step S2).

In step S3, the envelope Pf is fed from the envelope tray (for example, refer to feed cassette 15A or tray 24 of FIG. 1) of the side of the coping machine 1. As described with reference to FIG. 9, the envelope Pf is carried from the copy machine 1 to the vertical conveyance path 42 of the SSP device 3. Next, as described with reference to FIG. 10, the envelope Pf is carried to the enclosing portion where the enclosing device exists, by the pair of chuck rollers 59 and 60 (step S4).

Next, the process proceeds to step S5 and it is checked whether the envelope detecting sensor 62 is turned on. At this time, as described with reference to FIG. 11, if the envelope detecting sensor 62 detects the passage of the end of the flap Pfc of the envelope Pf as ON, the envelope detecting sensor 62 carries the envelope Pf by the defined amount and stops its operation (step S6). As shown in FIG. 11, the envelope Pf is fed by the defined amount according to the length: the vertical size of the envelope Pf, such that the opening Pon of the envelope Pf is positioned at the lower side of the lower end 61*a* of the opening mylar 61. Meanwhile, in step S5, when the envelope detecting sensor 62 is not turned off, the carriage of the envelope in step S4 is continued.

After step S6 where the envelope Pf is carried by the defined amount and the envelope detecting sensor 62 stops its operation, the envelope Pf is carried in a reverse direction by the defined amount (step S7). That is, as shown in FIG. 11, the pair of chuck rollers 59 and 60 start inversely rotate in a direction of an arrow E and the envelope Pf performs switchback and goes up the vertical conveyance path 42. When the switchback is performed, the lower end 61*a* of the opening mylar 61 contacts a part of the flap Pfc of the envelope by the elastic force. Therefore, the lower end 61*a* of the opening mylar enters in the opening Pon of the envelope Pf as shown in FIG. 12 and opens the opening Pon of the envelope Pf, and the opening mylar becomes a guide to enter the paper or the paper bundle as the enclosing material. In this state, the inverse rotation of the pair of chuck rollers 59 and 60 is stopped and ascending of the envelope Pf is stopped. Therefore, the envelope Pf is set in an opening state where the lower end 61*a* of the opening mylar 61 is inserted into the opening Pon of the envelope Pf, as shown in FIG. 13.

Next, the process proceeds to step S8, the vertical moving mechanism 223 is operated, the envelope fence 221 and the load cell 222 that are the measuring mechanism portion moves from the previously set initial position to the setting position ascended by the defined amount according to the size of each envelope, and the envelope fence 221 is stopped in a portion that does not contact the lower end of the envelope Pf and enters in a standby state. The setting position is set such that the distance of the conveying path between the top surface (envelope contact surface) of the envelope fence 221 and the center of the nip portion of the pair of chuck rollers 59 and 60 becomes equal to or more than the vertical length of the used envelope Pf, to measure only the weight of the paper-enclosed envelope Pf (refer to FIG. 24B).

Then, after 0-setting of the load cell 222 in step S9, the process proceeds to step S10, and the paper P (or paper bundle) that is the content is inserted into the envelope Pf from the pack unit 46 shown in FIGS. 22 and 23 via the opening Pon of the opened envelope Pf. At this time, the envelope arrival sensor 228 detects the lower end of the envelope Pf as ON (refer to FIGS. 24B and 24C).

Next, after the paper is enclosed in the envelope Pf (refer to FIG. 24C), the nip pressure of the pair of chuck rollers 59 and 60 is completely released, that is, the chuck roller 59 is apart upward from the chuck roller 60 and the nip pressure is released by the nip pressure releasing/applying mechanism (not shown in the drawings), and almost the entire weight of the envelope Pf is applied, to the load cell 222 (step s11). Then, weight measurement to be described below is executed on the basis of an ON signal from the envelope arrival sensor 228 (step S12).

In step S12, the paper-enclosed envelope Pf gets on the envelope fence 221 and the weight (mass) of the envelope Pf after enclosing the paper is measured by the load cell 222. Data of the weight that is measured by the load cell 222 is transmitted to the control device 120 of the device body 1A through the SSP control board 140 of FIG. 33 that is provided on the side of the SSP device 3. After the weight data is transmitted, the nip pressure of the pair of chuck rollers 59 and 60 is restored by the nip pressure releasing/applying mechanism (not shown in the drawings).

The control device 120 of the device body 1A transmits a signal related to setting of the discharge destination (designation tray) set to be described below in the operation panel 100 of FIGS. 32A and 32B to the SSP control board 140 of the side of the SSP device 3, on the basis of the weight data, and sends a reply to the enclosing device (step S13). On the basis of the signal related to the setting of the discharge destination (designation tray), as shown in FIG. 25, the paper-enclosed envelope Pf is discharged to the designated discharge destination tray that constitutes the sorting unit in the storage carrier 4 shown in FIG. 31 (step S14).

In FIG. 25, when the paper-enclosed envelope Pf is discharged to the storage carrier 4 shown in FIG. 31, the pair of chuck rollers 59 and 60 starts to rotate in an arrow direction. At the same time, the belt 226 of the vertical moving mechanism 223 travels and rotates in a clockwise direction, and the envelope fence 221 is evacuated to the position below the driving pulley 225 that does not hinder carriage of the paper-enclosed envelope Pf in a vertical direction Z (the position below the driving roller may be the initial position of the envelope fence 221 and the load cell 222).

Next, the process proceeds to step S15, and it is checked whether the final envelope of the designated job is output and discharged. In this case, if the final envelope of the designated job is output and discharged, the series of operations that is related to the enclosing mode ends. If the final envelope is not output and discharged, the process returns to step S3 and the series of operations from step S3 is repeated.

Therefore, according to this embodiment, a switching member to switch a discharge/carriage direction of the paper-enclosed envelope Pf, a carriage guiding member to form a conveying path switched by the switching member or a special discharging/carrying member to discharge the envelope is not newly disposed, and the configuration can be simplified and the number of components can be decreased. Therefore, a manufacturing cost can be decreased.

Figure 28:
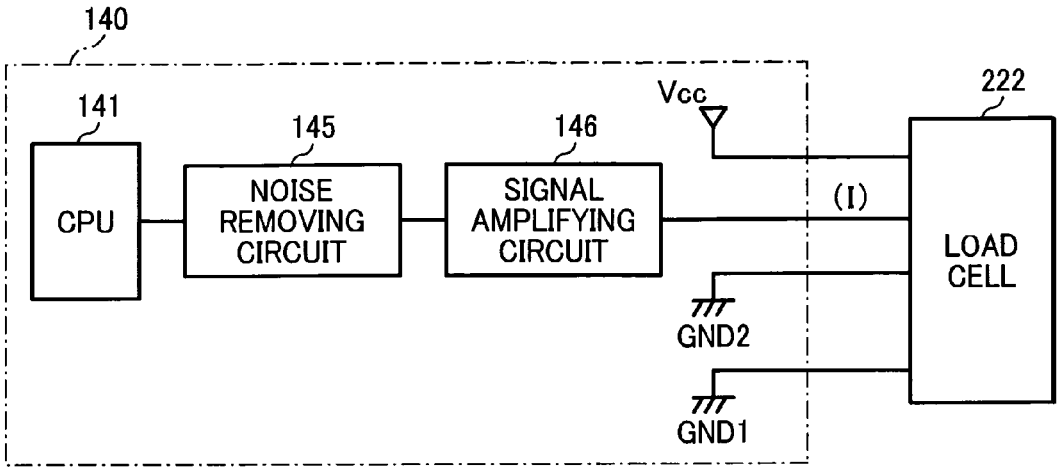
FIG. 28 is a block diagram of a weight measuring unit using a load cell.
Figure 29:
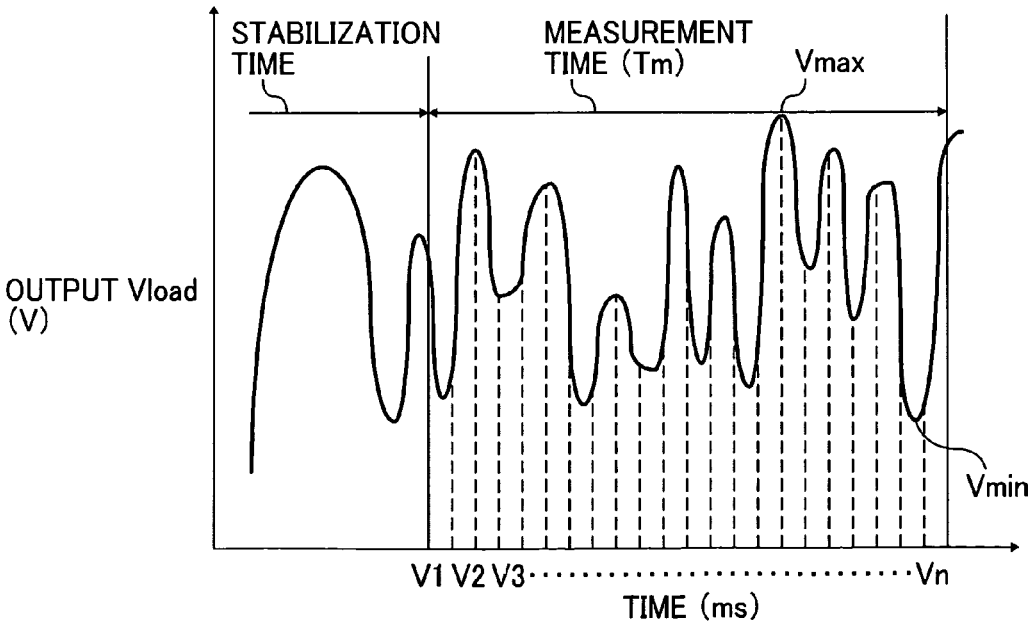
FIG. 29 is a graph illustrating a relationship of an output voltage from the load cell and a time.

Referring to FIGS. 28 and 29, a weight measuring method that measures the weight of the envelope Pf using the load cell 222 will be described. FIG. 28 is a block diagram of the weight measuring section using the load cell 222.

As shown in FIGS. 28 and 29, the load cell 222 and an SSP control board 140 (this means a control device of the SSP device 3, which is described later with reference to FIG. 33) are connected by four electric lines of a power supply voltage Vcc: 12 V, GND1, GND2, and an output signal (l). The GND is divided into two systems of the GND1 of a 12 V power supply system and the GND2 of a signal system to decrease the noise. An output VLoad (V) of the load cell 222, after potential thereof is amplified by a signal amplifying circuit 146 in the SSP control board 140, passes a noise removing circuit 145, and is read by a CPU 141 at an analog port (not shown in the drawings) so that the weight can be measured.

FIG. 29 shows a relationship of output voltage VLoad data (vertical axis) after subjected to an AD (analog/digital) conversion in the CPU 141 and a time (horizontal axis). Before the measurement of the weight starts, a time until the output VLoad is stabilized, that is, a stabilization time is generally set in consideration of existence of a time corresponding to an unstable output voltage VLoad as a characteristic of the load cell 222. After the stabilization time passes, the CPU 141 reads weight data of the envelope that is close to a true value. The read value is measured by a fixed number n in Tm time, where the time Tm denotes a measurement time. In order to minimize the measurement error, an average of the (n−2) output voltage data other than the maximum value Vmax and the minimum value Vmin among the measured data is used. The weight (corresponding voltage) VL that is measured in the above-described way can be calculated by the following equation (1).

$$VL=\{(V1+V2+\ldots Vn)-(V\max+V\min)\}/(n-2) \quad (1)$$

In this case, a processing example of the weight measurement data of the paper-enclosed envelope will be described. For example, when plural paper-enclosed envelopes are manufactured as the mails of the same contents, in order to prevent generation of defects or overlapping of the contents in advance, the weight of the paper-enclosed envelope is measured, OK determination is performed when the weight is in a predetermined range, NG determination is performed when the weight is out of the predetermined range, and inspection can be performed. The image forming system that has the weight measuring function according to the present invention has an inspection function, as described above.

The weight data of the paper-enclosed envelope is transmitted from the post-processing device having the enclosing/sealing function to the image forming device body. The image forming device body receives the weight data and transmits the determination result of OK or NG to the post-processing device having the enclosing/sealing function. In the post-processing device having the enclosing/sealing device, for example, the envelope that is determined as OK and the envelope that is determined as NG are sorted into the different trays or the envelope that is determined as NG is discharged without being sealed to manually change the contents.

However, the weight of the paper is changed by absorption of the moisture by the environmental humidity. The weight of the same content in the same envelope is slightly changed according to the date of manufacture or the difference of the production lot of the used paper.

In the image forming system according to the present invention, for example, when the work starts, an envelope making job of the predetermined amount is executed, the weight data thereof is statistically handled, validity of the OK and NG ranges is determined, and a determination reference value is automatically set. An example is shown in Table 1.

TABLE 1

| | n | | | | | | | | | | (1) | (2) | (3) | (4) |
|---|---|---|---|---|---|---|---|---|---|---|---|---|---|---|
| | 1 | 2 | 3 | 4 | 5 | 6 | 7 | 8 | 9 | 10 | Ave. | 2σ | OKmin | OKmax |
| Weight [g] | 23.4 | 23.2 | 23.5 | 23.1 | 23.9 | 23.0 | 23.5 | 23.2 | 23.4 | 23.8 | 23.4 | 0.551 | 22.849 | 23.951 |

In Table 1, on the basis of ten weight data samples of the paper-enclosed envelopes, (1) an average (Ave.) is calculated, (2) a 2σ value is calculated, and (3) and (4) Ave.±2σ is set as OK and NG determination references (OKmin and OKmax).

The user can set the number of weight data samples that are used in the calculation, determine whether the width of the determination reference is 2σ or 3σ, and determine whether a reference is set by a different numerical expression. This operation or setting is given by setting and inputting from the operation panel 100 of the device body 1A.

Figure 30:
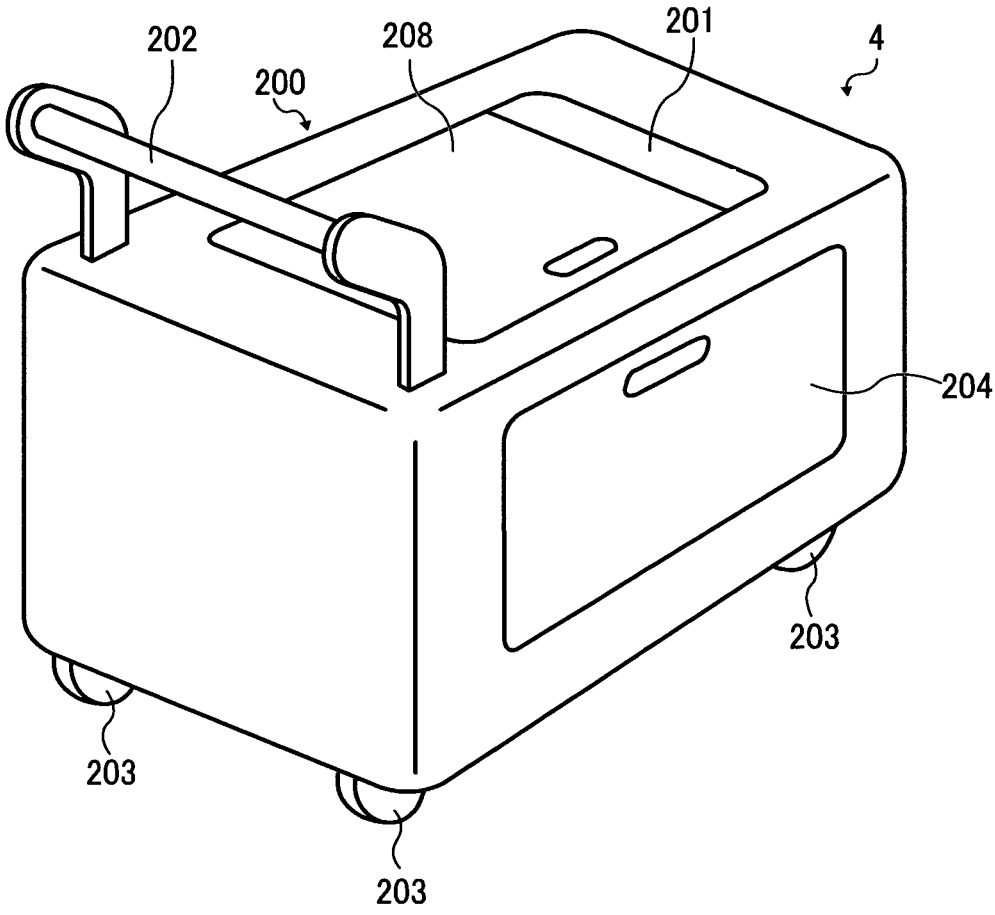
FIG. 30 is a perspective view of the exterior of a storage carrier.

Referring to FIGS. 30 and 31, the storage carrier 4 that includes the sorting unit according to the present invention will be described in detail. As shown in FIG. 30, the entire storage carrier 4 is covered by a box-like case 200 and an insertion port 201 to insert the paper-enclosed envelope is formed on a top surface of the storage carrier 4. A handle 202 is attached to one end of the top surface of the case 200 and four casters 203 are attached to a bottom surface of the case 200. As a result, the entire storage carrier 4 can be separated from a device body 3A of the SSP device 3.

Meanwhile, a feed port 233 that faces and communicates with the insertion port 201 is formed on the side of the device body 3A.

An upper extraction port 208 is formed in the top surface of the case 200 and a front extraction port 204 is formed in a front surface of the case 200, such that the paper-enclosed envelope is easily extracted from each of the extraction ports 204 and 208. As shown in FIG. 31, upper and lower lock mechanisms 205 and 206 are mounted on a right side of the case 200 and a connector 235 is attached to an upper portion. When the storage carrier 4 is mounted to the predetermined position of the device body 1A as shown in FIG. 31, the storage carrier 4 is locked by the upper and lower lock mechanisms 205 and 206, the connector 235 is connected to the connector of the side of the device body 3A, and electric connection is given.

As shown in FIG. 31, a sorting device 190 that is an example of the sorting unit according to the present invention is provided in the storage carrier 4. The sorting device 190 has the function and the configuration of the sorting unit that sorts the paper-enclosed envelope Pf, on the basis of the weight data of each of the paper-enclosed envelope Pf of which the weight is measured by the load cell 222 shown in FIGS. 24A to 24C.

The sorting device 190 mainly includes a first tray 210, a second tray 211, a third tray 212, and an NG tray 213 that include plural sorting trays 191 functioning as loading units and loading stands to load the paper-enclosed envelopes Pf discharged by the pair of chuck rollers 59 and 60 of the envelope chuck section 45 and the vertical moving mechanism 223 functioning as the discharging unit, and a moving unit that selectively moves the sorting tray 191 of any one of the first tray 210, the second tray 211, the third tray 212, and the NG tray 213 to the position below the insertion port 201, on the basis of the weight data of each of the paper-enclosed envelopes Pf of which the weight is measured by the load cell 222.

In the storage carrier 4, plural vertical plates 214 that are erected in a vertical direction and move in a direction of an arrow N are provided on a tray bottom plate 209. The envelopes Pf that are discharged from the insertion port 201 are received and stored on the sorting tray 191 defined and formed between the vertical plates 214 moved to the position below the insertion port 201 and the tray bottom plate 209. A lower portion of the tray bottom plate 209 is mounted and fixed to the top surface of a belt 218 as described below.

The moving unit that selectively moves any one of the plural sorting trays 191 mainly includes an endless belt 218 that is suspended between a driving pulley 216 and a driven pulley 217, a stepping motor 219 (hereinafter, simply referred to as "motor 219") that is driven with a pulse input to rotate and drive the driving pulley 216, and a home position sensor 215 that detects the home position (initial position) of the sorting tray 191.

The toothed belts 218 that are provided in the front side and the inner side (not shown) of a plane of paper are suspended between the driving pulley 216 and the driven pulley 217 of the pair that are provided in each of the front side and the inner side (not shown in the drawings) of the plane of paper. The driving pulley 216 is connected to a motor 219 through a driving force transmitting unit (not shown in the drawings) made of a gear or a belt.

On each of the belts 218 that are provided on the front side and the inner side (not shown in the drawings) of the plane of paper, a lower portion of the tray bottom plate 209 is mounted and fixed. Thereby, each of the belts 218 of the front side and the inner side (not shown in the drawings) of the plane of paper is connected firmly by the tray bottom plate 209.

The home position sensor 215 is composed of a light shielding photo sensor. In an example shown in the drawings, the home position sensor 215 is disposed to detect the central position of the sorting tray 191 that is positioned at the leftmost side in the first tray 210.

The plural sorting trays 191 are partitioned by partition members 210*a*, 211*a*, 212*a*, 213*a*, and 214*a* at the predetermined interval, such that the plural trays 210 to 213 functioning as the plural loading stands are formed. That is, the first tray 210 is formed between the plural vertical plates 214 and the tray bottom plate 209 partitioned by the partition member 210*a* and the partition member 211*a*, the second tray 211 is formed between the plural vertical plates 214 and the tray bottom plate 209 partitioned by the partition member 211*a* and the partition member 212*a*, the third tray 212 is formed between the plural vertical plates 214 and the tray bottom plate 209 partitioned by the partition member 212*a* and the partition member 213*a*, and the NG tray 213 is formed between the plural vertical plates 214 and the tray bottom plate 209 partitioned by the partition member 213*a* and the partition member 214*a*.

The first tray 210 includes four sorting trays 191, the second tray 211 includes four sorting trays 191, the third tray 212 includes two sorting trays 191, and the NG tray 213 includes two sorting trays 191. The first tray 210, the second tray 211, and the third tray 212 function as the OK trays 210 to 212.

The distance d between the partition member 210*a* and the vertical plate 214 in the first tray 210 and the distance d between the vertical plates 214 in the first tray 210 become equal to each other. Likewise, the distances d are equal to each other the in the second tray 211, the third tray 212, and the NG tray 213.

The distance d1 between the center of the first sorting tray 191 from the left side of the drawing in the first tray 210 and the center of the second sorting tray 191, the distance d2 between the center of the first sorting tray 191 from the left side of the drawing in the first tray 210 and the center of the third sorting tray 191, the distance d3 between the center of the first sorting tray 191 from the left side of the drawing in the first tray 210 and the center of the fourth sorting tray 191 in the first tray 210, and the distance d4 between the center of the first sorting tray 191 from the left side of the drawing in the first tray 210 and the center of the first sorting tray 191 in the second tray 211, and the following distances d5, . . . are set to the predetermined distances. Relation data of the distance between the sorting trays 191 and a driving pulse number to move the tray by the distance is stored in a ROM 142 that is provided in an SSP control board 140 shown in FIG. 33 in a form of a data table.

By the above configuration, the motor 219 rotates by the predetermined step number by the signal according to the driving pulse number set according to the sorting to be transmitted from the CPU 141 of the SSP control board 140 shown in FIG. 33 through the connector 235, the belt 218 is moved by the amounts corresponding to the distances d1, d2, d3, d4, . . . set for the sorting trays 191 of the trays 210 to 213, the sorting trays 191 of the trays 210 to 213 are moved to the paper reception position becoming the position below the insertion port 201, and the sequentially discharged paper-enclosed envelopes can be sequentially stored in the sorting trays 191 where the paper-enclosed envelopes are not stored, in cooperation with the RAM 143 provided in the SSP control board 140 shown in FIG. 33.

Next, the operation panel 100 that functions as the operation portion will be described with reference to FIGS. 32A and 32B. FIGS. 32A and 32B are plan views showing a main portion of the operation panel 100 that is provided with various operation keys and a display unit used when various modes are selected or various copy conditions are set. The operation panel 100 has a hard key such as a start key 108 or a ten key 105 shown in FIG. 32A to give various instructions of printing and image forming conditions and a display unit 104 that is composed of a touch panel integrated with a touch sensor screen including a liquid crystal display (LCD). The display unit 104 of the touch panel type has a hierarchical display structure and screen display of the display unit can be switched into next screen display, when a "next" button or various keys are pressed.

As shown in FIG. 32A, in the operation panel 100, 10 ten keys 105 (which becomes a sheet number setting unit to set the number of paper) that is used when the copy number is selected and instructed, the number of paper enclosed in the envelope is set or a document recirculating mode is selected are disposed. The enter key 107 is disposed at the lowermost step of the operation panel 100, and a stop/clear key 106 and the start key 108 that is pressed to start a copy operation are disposed on the right side thereof.

As shown in detail in FIG. 32B, in the display unit 104, a package key 101 that is pressed when a "pack mode (paper enclosing mode)" to automatically enclose the paper in the envelope is selected, a sorting key 102 that is pressed when a "sorting mode" to sort the copied paper and discharge the paper to the bin is selected, and a staple key 103 that is pressed when a "staple mode" to bind the paper on the bin is selected are provided. In the display unit 104, there is provided a display portion that is disposed on the upper side and displays the size of the envelope where the paper can be enclosed or a message indicating that the envelope where the paper can be enclosed does not exist.

On the left side of the display unit 104, paper/envelope selection keys 109*a* to 109*e* and a paper/envelope display portion 110 which is disposed on the upper side and in which illustrations (not shown in the drawings) drawing the individual trays to correspond to the five selection keys are displayed and two left and right lamps (not shown in the drawings) are disposed below each illustration are provided. When the envelope is selected, the right lamp is turned on with a green color and an envelope size is displayed below the lamp. When the paper (copying paper) is selected, the left lamp is turned on with an orange color and a paper size is displayed below the lamp.

The key that is provided on the lower side of the paper/envelope selection key 109*d* is an envelope selection mode switching key 111. The envelope selection mode switching key 111 is pressed when the envelope having the optimal size to enclose the paper on the bin in the envelope is automatically selected or when a mode to allow the operator to freely select the envelope size is selected.

For example, the user may desire to sort the envelopes according to the postage, on the basis of the weight data of the enclosed envelopes. In this case, the main control board 130 of the control device 120 shown in FIG. 33 controls the sorting device 190 to sort the enclosed envelopes, on the basis of the threshold value of the weight data of the enclosed envelopes. The threshold value is calculated on the basis of the weight data of the predetermined number of the paper-enclosed envelopes.

In this case, a weight range according to the postage is set by the operation panel 100 and the envelopes are sorted according to the weight range.

If the pack mode (envelope enclosing mode) is selected by pressing the package key 101 shown in FIG. 32B, a sorting mode key 112 and an inspection mode key 113 that function as an envelope enclosing mode selection key displayed as "envelope enclosing" are displayed. In this case, if the sorting mode key 112 is selected, an enclosing condition setting tab key 114 is displayed. If the enclosing condition setting tab key 114 is pressed and selected, a screen to set an enclosing sorting condition is displayed.

On the sorting condition setting screen, selection keys of the lower limit (g) of the weight, the upper limit (g) of the weight, and the sorting trays of the discharge destination are displayed. In this case, each tray of the discharge destination can be selected according to the weight range of the enclosed envelopes. At the time of setting, the lower limit of the weight is set by pressing one key of a weight lower limit key group 115 (including keys to set four ranges, as shown in FIG. 32B) and the upper limit of the weight is set by pressing one key of a weight upper limit key group 116 (including keys to set four ranges, as shown in FIG. 32B). The setting of the specific numerical value of the weight range becomes setting/inputting in the ten key 105 of FIG. 32A. After the weight range is input, any one of the first to third trays 210, 211, and 212 of the discharge destinations is selected and set by pressing and selecting any one of sorting tray selection keys 117*a*, 117*b*, 117*c*, and 117*d* (fourth tray for sorting is not shown in FIG. 31 to clarify the configuration). The specific numeral values of the lower limit (g) of the weight and the upper limit (g) of the weight that are displayed in FIG. 32B are only exemplary. In actuality, the specific numeral values are set by the postage system list in the "Japan postal service."

As described above, the sorting tray selection keys 117*a*, 117*b*, 117*c*, and 117*d* function as the setting unit that sets the paper-enclosed envelopes sorted by the sorting device 190 to be loaded on any one of the first to third trays 210, 211, and 212 according to each weight.

In this embodiment, similar to Japanese Patent Nos. 3110806 and 3110804, when the plural envelopes having the sizes capable of storing paper exist as the result of the collation of the sizes of the envelopes that can store the paper fed from the feed portion 11 and the sizes of the envelopes set to the device body 1A, a "first mode" and an "automatic envelope selection mode" to automatically select the envelope having the minimum size, a "second mode" and an "operator envelope selection mode" to display all of the envelopes having the sizes capable of storing the paper on the display unit 104, and an "operator envelope supporting mode" to notify the envelopes having the sizes capable of storing the paper by flickering the illustrations of the paper/envelope display unit 110 can be selected by pressing the envelope selection mode switching key 111 (refer to FIGS. 32A and 32B) functioning as the mode selecting unit.

Next, the entire control configuration of the image forming system according to this embodiment will be described with reference to FIG. 33. FIG. 33 is a block diagram illustrating the control device 120 to wholly control the image forming system of the copy machine 1 and the SSP device 3 in this embodiment, and illustrating the association configuration thereof. The control device 120 includes a main control board 130 that controls an image forming system in the copy machine 1 and an SSP control board 140 that performs operation control of the sort/staple/package, etc.

Figure 27:
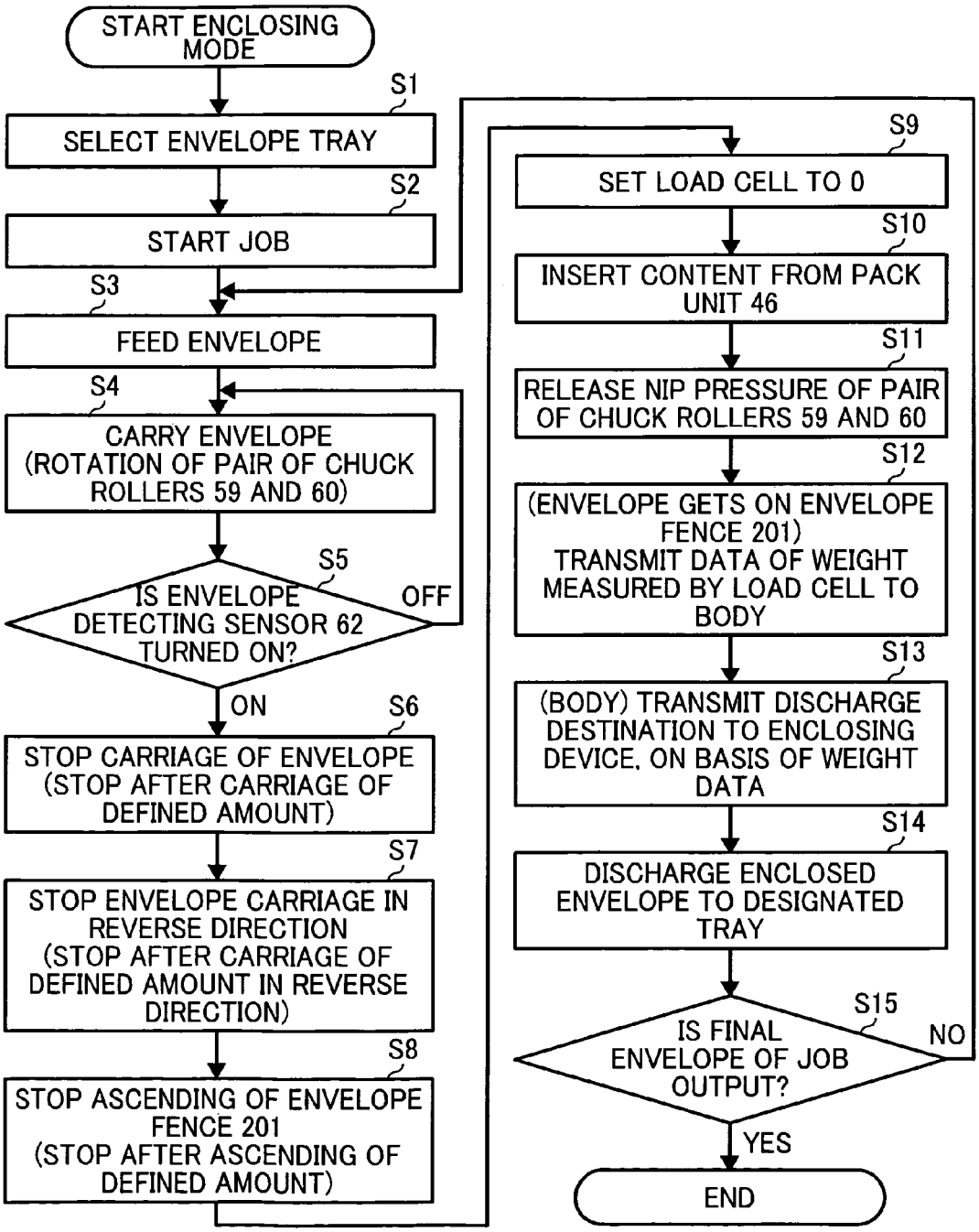
FIG. 27 is a flowchart illustrating an operation of a paper enclosing mode.
Figure 34:
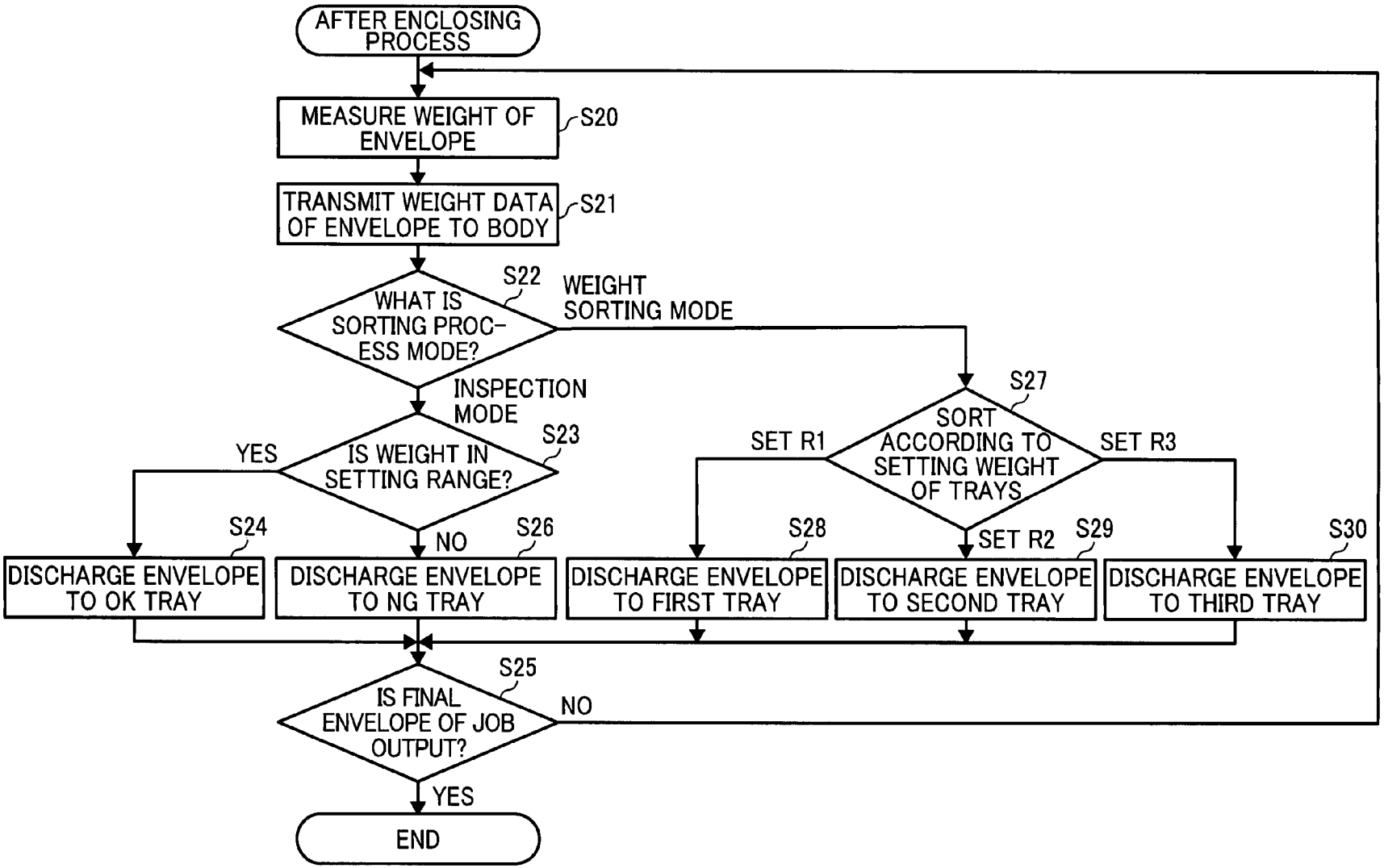
FIG. 34 is a flowchart illustrating an operation of a sorting process mode after a sheet enclosing process.

The main control board 130 includes a central processing unit (CPU) 131 that has various determining and processing functions, a read only memory (ROM) 132 that stores processing programs including a program (For example, operation programs related to flowcharts as shown in FIGS. 27 and 34) needed to control various driving systems in the copy machine 1 (refer to FIGS. 1 and 2) and fixed data, a random access memory (RAM) 133 that is a data memory to store processing data, and an input/output circuit (I/O).

The CPU 131 of the main control board 130 inputs sensor signals output to correspond to a paper size or an envelope size from each size detecting sensor 32 provided in each of the feed cassettes 15A to 15D (refer to FIG. 1) of the feed portion 11 and the size detecting device 30 provided in the tray 24, inputs sensor signals from various sensors such as a synchronization detecting sensor and a paper end sensor, determines timing to turn on/off various loads such as various discharging devices, a developing motor, a high-voltage power supply, a polygon motor, a semiconductor laser of a writing portion 6 of FIG. 2, a fixing device, and a motor to drive a photosensitive drum 7, and executes an entire sequence operation.

The main control board 130 is connected to the various keys provided in the operation panel 100 of FIGS. 32A and 32B, a scanner control board 122 that is the control circuit of the image scanning portion 5 of FIG. 2, and an RDH control board 123 that is the control circuit of the RDH of FIG. 2, and is connected to a personal computer 125 through an external interface 124. Each control board is configured to enable bidirectional communication and exchange a command. The scanner control board 122 and the external interface 124 also receive an output of the image data.

Similar to the main control board 130, the SSP control board 140 includes a central processing unit (CPU) 141 that has various determining and processing functions, a read only memory (ROM) 142 that stores processing programs including a program needed to control various driving systems in the SSP device 3 (refer to FIG. 2) and fixed data, a random access memory 143 that is a data memory to store processing data, and an input/output circuit (I/O).

The SSP control board 140 is connected to the main control board 130, serial communication is enabled between the SSP control board 140 and the main control board 130, and the SSP control board 140 is operated according to a command transmitted from the main control board 130. The CPU 141 of the SSP control board 140 receives various detection signals from the various sensors, such as the envelope arrival sensor 228 (refer to FIGS. 24A and 31), each home position sensor (not shown in the drawings) to detect each home position of the SSP unit 40 in a vertical direction and a horizontal direction, a sensor (not shown in the drawings) to detect a mounting state of the storage carrier 4 (refer to FIG. 2), the home position sensor 215 of the sorting device 190, a sensor (not shown in the drawings) to detect the envelope being not discharged to the storage carrier 4, and the envelope detecting sensor 62 (refer to FIGS. 6 and 12).

The CPU 141 of the SSP control board 140 receives a signal related to the weight data from the load cell 222 of the weight measuring device 220 shown in FIGS. 24A to 24C.

The CPU 141 of the SSP control board 140 outputs driving signals to a motor driver to drive a motor 151 rotating the pulley 49 (refer to FIG. 6) where the conveyance belt 48 constituting the vertical conveyance path 42 is stretched, a motor driver to rotate a chuck roller driving motor 153 of the envelope chuck section 45, a motor driver to drive a motor 155 to cause the pair of pack units 46 to approach each other or be apart from each other, according to the size of the paper on the bin 35, a motor driver to drive the driving motor 227 of the vertical moving mechanism 223 shown in FIGS. 24A to 24C, and a motor driver to rive the motor 219 to selectively move the individual trays 210 to 213 on the belt 218, on the basis of the weight data from the load cell 222, respectively.

The CPU 141 of the SSP control board 140 outputs driving signals to a motor driver to rotate a motor 157 to ascend and descend the SSP unit 40 (refer to FIG. 6), a motor driver to drive the motor 74 (refer to FIG. 16) to descend the upper roller 65 and nip the paper on the bin 35 between the upper roller 65 and the lower roller 66, a motor driver to drive the chuck motor 84 (refer to FIG. 18) to rotate the upper and lower rollers 65 and 66, a motor driver to drive the staple motor 10 to operate the stapler 47 (refer to FIG. 19), and a driver to drive a solenoid 55 to swing the sort guides 53 and 54, respectively.

This embodiment has the above configuration and the control configuration of FIG. 33 so that the operation that is disclosed in the flowchart of FIGS. 29 and 31 of Japanese Patent No. 3110804 and the operation that is described in the paragraphs [0082] and [0086] to [0113] can be executed. In addition, the operation that is disclosed in the flowchart of FIGS. 30 to 34 of Japanese Patent No. 3110806 and the operation that is described in the paragraphs [0096] to [0121] can be executed.

Referring to a flowchart of FIG. 34, a sorting process of the paper-enclosed envelopes will be described. Steps S20 and S21 in FIG. 34 are the same as step S12 described in FIG. 27. In step S22, what is set as a sorting process mode is checked.

In this case, the "inspection mode" is a mode in which an average±2σ is acquired by statistical calculation from n samples, the weight of enclosing products to be made thereafter is compared, and it is determined whether the enclosing products are defective or overlapped, when the plural paper-enclosed envelopes (enclosing products) equal to each other are made. The "weight sorting mode" is a mode in which the weight range sorted to each tray is set in advance and the envelopes are sorted for each weight range, when various enclosing products are made. For example, the weight sorting mode includes a sorting mode according to the postage.

In step S22, after the pack mode (envelope enclosing mode) is selected by the package key 101 shown in FIG. 32B, the sorting mode key 112 and the inspection mode key 113 that function as the envelope enclosing mode selection key displayed as the "envelope enclosing" are displayed. In this case, if the inspection mode is selected and set by pressing the inspection mode key 113, the process proceeds to step S23, and it is checked whether the weight of the paper-enclosed envelope is in the setting range. When the weight is in the setting range, the sorting device 190 is operated, the first to third trays 210, 211, and 212 that correspond to the OK trays are selected, and each sorting tray 191 is selectively moved to occupy the position below the insertion port 201 toward the right side from the left side of FIG. 31 where the paper-enclosed envelopes are not stored. Then, by the above operation, the paper-enclosed envelopes of the inspection OK are discharged from the side of the SSP unit 40 to each sorting tray 191 of the first to third trays 210, 211, and 212 (step S24). Then, the process proceeds to step S25, it is checked whether the final envelope of the job is output and discharged. When the final envelope is output and discharged, the mode after the enclosing process ends.

Meanwhile, in step S23, in the case of NO where the weight of the paper-enclosed envelopes is not in the setting range, the sorting device 190 is operated, the NG tray 213 is selected, and each sorting tray 191 is selectively moved such that each sorting tray 191 of the NG tray 213 occupies the position below the insertion port 201. Then, by the above operation, the paper-enclosed envelopes of the inspection NG are discharged from the side of the SSP unit 40 to each sorting tray 191 of the NG trays 213 (step S26).

Meanwhile, in step S22, after the sorting mode key 112 shown in FIG. 32B is pressed, if the weight sorting mode is selected and set by pressing the enclosing condition setting tab key 114, the process proceeds to step S27, and the bifurcating operation for sorting according to the setting weight of each tray is executed. That is, in step S27, when the user sets R1, the lower limit and the upper limit of the weight that are exemplified in FIG. 32B are set to no lower limit<20 by the lower limit key group 115 and the upper limit key group 116. If the first tray key 117*a* is pressed to execute the weight sorting mode, the sorting device 190 is operated, the first tray 210 that functions as the OK tray is selected, and each sorting tray 191 is selectively moved to occupy the position below the insertion port 201 toward the right side from the left side of FIG. 31 where the paper-enclosed envelopes are not stored. Then, by the above operation, the paper-enclosed envelopes of the weight of the setting R1 are discharged from the side of the SSP unit 40 to each sorting tray 191 of the first tray 210 (step S28).

If the user presses the second tray key 117*b* to execute the weight sorting mode in the case where the user sets R2 through the same operation as the above case (in the case where the lower limit and the upper limit of the weight exemplified in FIG. 32B are 20<30), the paper-enclosed envelope of the weight of the setting R2 is discharged to each sorting tray 191 of the second tray 211 (step S29). If the user presses the third tray key 117*c* to execute the weight sorting mode in the case where the user sets R3 (in the case where the lower limit and the upper limit of the weight exemplified in FIG. 32B are 30<50), the paper-enclosed envelope of the weight of the setting R3 is discharged to each sorting tray 191 of the third tray 212 (step S30).

In this embodiment, the "automatic paper selection" mode that functions as the automatic sheet selection mode can be executed. For example, in the case of the copy machine 1 that functions as the image forming device of FIG. 2, the automatic paper selection mode is a mode in which the copy machine includes the plural feed cassettes 15A to 15D and the trays 24 functioning as the sheet storing units to store the paper (sheet) having the same size to be fed to form an image, and the paper stored in any one of the plural feed cassettes 15A to 15D and the trays 24 is automatically fed, when there is no paper stored in any one of the plural feed cassettes 15A to 15D and the trays 24.

When the "automatic paper selection" mode is not selected as the setting of the feed destination, as described above, switching with respect to any one of the plural feed cassettes 15A to 15D and the trays 24 is not generated. However, the user forgets the setting and any one of the feed cassettes 15A to 15D and the trays 24 may be switched into the tray that is not intended. Even though the paper sizes are the same, when setting of the paper type becomes different and the paper having the different type and basis weight is stored in any one of the feed cassettes 15A to 15D and the trays 24, the weight of the paper that is enclosed in the envelopes becomes different, and this causes difficulty in the sorting or the inspection based on the weight.

Therefore, in order to prevent the difficulty in the sorting or the inspection based on the weight in advance, in the case of the job of enclosing, when setting of the paper type is different in the trays having the same size, even in the "automatic paper selection" mode, the feed cassettes 15A to 15D and the trays 24 are not switched, and the paper is fed from only any one of the feed cassettes 15A to 15D and the trays 24 of the designated destination.

As described above, the present invention is described using the embodiment and the modifications. However, the technical range that is disclosed in the present invention is not limited to the technical range exemplified in the embodiment or the modifications, and various configurations may be appropriately combined. It can be apparent to those skilled in the art that various embodiments or modifications can be configured according to necessity and purpose, in the technical range of the present invention.

For example, in the sorting device 190 shown in FIG. 31, since the sorting tray 191 is provided using the reciprocating mechanism using the belt 218, the plural sorting trays 191 cannot be disposed. However, as a modification to resolve the above problem, sorting trays are formed in a cylindrical shape in external view and a doughnut shape in plan view, the sorting trays are partitioned by plural partition members that extends in a radial direction from the center of a cylinder in a space of the doughnut shape, the sorting trays are configured to rotate by rotation of the central axis of the cylinder, and the plural trays and sorting trays of the discharge destinations can be configured.

The sorting unit is not limited to the sorting device 190 of FIG. 31, and the sorting unit can be configured using a switching claw functioning as a sheet carriage direction switching unit to change the discharge destinations of the plural sheet-enclosed envelopes of which the weight is measured or a sheet conveying path corresponding to the switching claw.

According to the invention, by the above-configuration, the above-problems can be resolved and a novel image forming system can be realized and provided. That is, according to the invention, the image forming system includes the weight measuring unit that measures the weight of the sheet-enclosed envelopes and the sorting unit that sorts the sheet-enclosed envelopes, on the basis of the weight data of each of the sheet-enclosed envelopes of which the weight is measured by the weight measuring unit. Therefore, the function of the image forming system including the enclosing unit (enclosing device) and the image forming unit (image forming device) may be improved, and also the convenience of using the system may be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming system, comprising:

an image forming unit that forms an image on sheets including envelopes;

an enclosing unit that encloses, in the envelopes, the sheets on which the image is formed by the image forming unit;

a weight measuring unit that measures a weight of the sheet-enclosed envelopes; and a sorting unit that sorts the sheet-enclosed envelopes, on the basis of weight data of each of the sheet-enclosed envelopes of which the weight is measured by the weight measuring unit, wherein the enclosing unit has a carrying unit that nips and carries the envelopes, the carrying unit has a pressure-contact releasing unit that releases a pressure-contact with respect to the envelopes, and when the weight of the sheet-enclosed envelopes is measured by the weight measuring unit, the carrying unit releases the pressure-contact with respect to the sheet-enclosed envelopes.

2. The image forming system of claim 1, further comprising:

a discharging unit that discharges, to the sorting unit, the sheet-enclosed envelopes after the measurement; and a loading unit that loads the sheet-enclosed envelopes discharged by the discharging unit.

3. The image forming system of claim 2, wherein the loading unit has a plurality of loading stands, and the sheet-enclosed envelopes sorted by the sorting unit are loaded on any one of the plurality of loading stands, according to the weight.

4. The image forming system of claim 2, wherein the loading unit has a plurality of loading stands, and the image forming system further comprises a setting unit that sets the sheet-enclosed envelopes sorted by the sorting unit to be loaded on any one of the plurality of loading stands according to the weight.

5. The image forming system of claim 1, wherein the sorting unit sorts the sheet-enclosed envelopes, on the basis of a threshold value, and the threshold value is calculated on the basis of the weight data of a the predetermined number of the sheet-enclosed envelopes.

6. The image forming system of claim 1, further comprising:

a plurality of sheet storing units that store the sheets of a same size which are fed such that the image is formed by the image forming unit, wherein the image forming system has an automatic sheet selection mode where the sheets stored in any one of the plurality of sheet storing units are automatically fed, when there are no sheets stored in one of the plurality of sheet storing units, and wherein in a case of enclosing the sheets in the envelope, when the automatic sheet selection mode is executed, even though there are no sheets in the sheet storing unit of a designated destination, only the sheets from the sheet storing unit of the designated destination are fed.

* * * * *